US011378899B1

(12) United States Patent
Hara et al.

(10) Patent No.: US 11,378,899 B1
(45) Date of Patent: Jul. 5, 2022

(54) THERMALLY CONDUCTIVE PIPE, THERMAL PROCESSING DEVICE, AND PROCESSING SYSTEM

(71) Applicant: FUJIFILM Business Innovation Corp., Tokyo (JP)

(72) Inventors: Toko Hara, Kanagawa (JP); Kiyoshi Koyanagi, Kanagawa (JP); Toshiyuki Miyata, Kanagawa (JP); Toru Inoue, Kanagawa (JP); Kazuyoshi Itoh, Kanagawa (JP); Sou Morizaki, Kanagawa (JP); Motoharu Nakao, Kanagawa (JP); Keitaro Mori, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/321,496

(22) Filed: May 16, 2021

(30) Foreign Application Priority Data

Dec. 22, 2020 (JP) ..... JP2020-211953

(51) Int. Cl.
*G03G 15/16* (2006.01)
*G03G 15/10* (2006.01)

(52) U.S. Cl.
CPC ..... *G03G 15/10* (2013.01); *G03G 2215/0658* (2013.01)

(58) Field of Classification Search
CPC .... G03G 15/10; G03G 15/80; G03G 15/2053; F28D 15/02; F28D 15/04; H05B 1/0241; H05B 3/0014
USPC ..... 399/122
See application file for complete search history.

(56) References Cited

FOREIGN PATENT DOCUMENTS

| | | |
|---|---|---|
| JP | H11337279 | 12/1999 |
| JP | 2002-022378 | * 1/2002 |
| JP | 2017-083138 | 5/2017 |

* cited by examiner

*Primary Examiner* — Hoan H Tran
(74) *Attorney, Agent, or Firm* — JCIPRNET

(57) ABSTRACT

A thermally conductive pipe includes a pipe having closed both end portions; a working fluid that is enclosed in inside of the pipe and that is vaporized and liquefied; and a liquid transfer member that extends in a longitudinal direction of the inside of the pipe and that transfers the liquefied working fluid at least in the longitudinal direction. An occupancy rate of a cross-sectional area of the liquid transfer member to a cross-sectional area in a transverse direction of the inside of the pipe is in a range of 20% or more and 50% or less.

20 Claims, 13 Drawing Sheets

THERMALLY CONDUCTIVE PIPE, THERMAL PROCESSING DEVICE, AND PROCESSING SYSTEM

CROSS-REFERENCE TO RELATED APPLICATIONS

This application is based on and claims priority under 35 USC 119 from Japanese Patent Application No. 2020-211953 filed Dec. 22, 2020.

BACKGROUND

(i) Technical Field

The present disclosure relates to a thermally conductive pipe, a thermal processing device, and a processing system.

(ii) Related Art

In related art, as a thermally conductive pipe referred to as a heat pipe or the like, for example, those described in Japanese Unexamined Patent Application Publication No. 11-337279 (claim 1 and so forth) and Japanese Unexamined Patent Application Publication No. 2017-83138 (claim 1, paragraph 0032, and so forth) are known.

Japanese Unexamined Patent Application Publication No. 11-337279 (claim 1 and so forth) describes a heat pipe including a pipe body having a hollow portion sealed at both ends, a working fluid being present in the hollow portion to perform heat exchange with the outside, and a wick mounted in the hollow portion of the pipe body to provide a capillary force to return the working fluid condensed in a condenser to an evaporator. The wick has a substantially cylindrical structure formed by braiding a large number of wires into a helical shape.

Japanese Unexamined Patent Application Publication No. 2017-83138 (claim 1, paragraph 0032, and so forth) describes a heat pipe including a container, a working fluid enclosed inside the container, and a wick provided on the inner surface of the container and made of sintered metal obtained by sintering metal powder. The occupancy rate of the wick in a heat absorber of the container is 65% to 90%, and the occupancy rate of the wick in a heat radiator of the container is 40% to 60%.

SUMMARY

Aspects of non-limiting embodiments of the present disclosure relate to a thermally conductive pipe, a thermal processing device, and a processing system capable of obtaining excellent thermal conductivity performance even when the cross-sectional area in the transverse direction intersecting the longitudinal direction of a pipe is reduced, compared with a case where the occupancy rate of the cross-sectional area of a liquid transfer member with respect to the cross-sectional area in the transverse direction of the inside of the pipe is not in a range of 20% or more and 50% or less.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a thermally conductive pipe including a pipe having closed both end portions; a working fluid that is enclosed in inside of the pipe and that is vaporized and liquefied; and a liquid transfer member that extends in a longitudinal direction of the inside of the pipe and that transfers the liquefied working fluid at least in the longitudinal direction. An occupancy rate of a cross-sectional area of the liquid transfer member to a cross-sectional area in a transverse direction of the inside of the pipe is in a range of 20% or more and 50% or less.

BRIEF DESCRIPTION OF THE DRAWINGS

Exemplary embodiments of the present disclosure will be described in detail based on the following figures, wherein.

DETAILED DESCRIPTION

Exemplary embodiments for implementing the present disclosure (merely referred to as exemplary embodiments in the specification) will be described below with reference to the drawings.

First Exemplary Embodiment

Figure 1A:
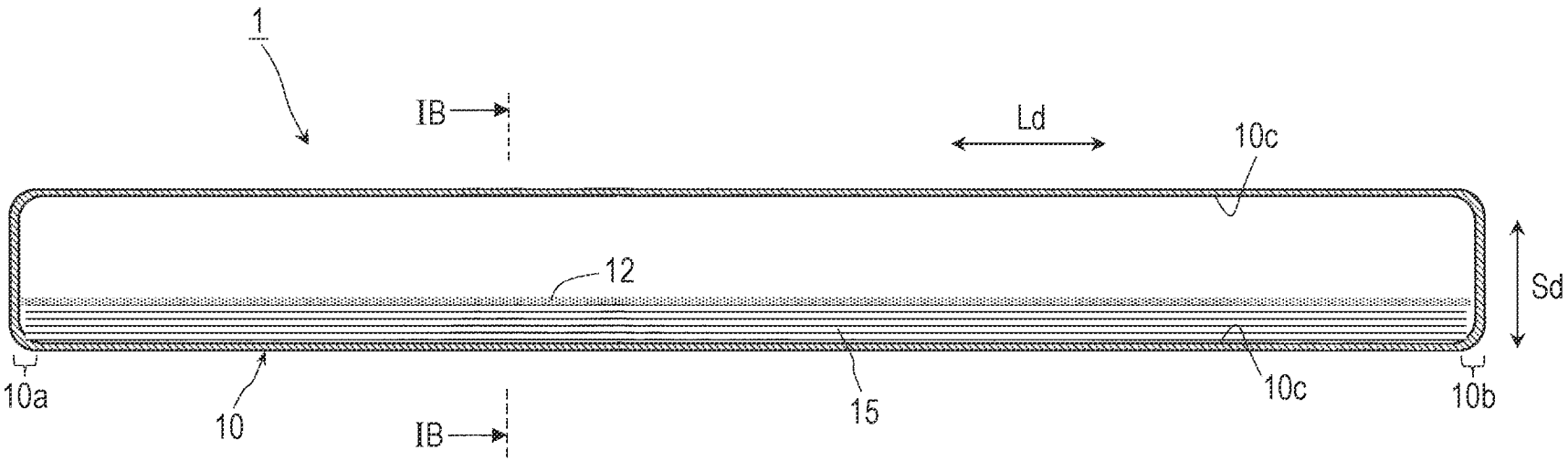
FIG. 1A is a schematic sectional view taken in the longitudinal direction of a thermally conductive pipe according to a first exemplary embodiment.
Figure 1B:
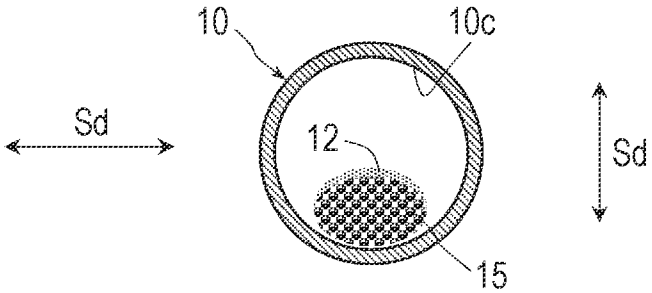
FIG. 1B is a schematic sectional view taken along line IB-IB of the thermally conductive pipe of FIG. 1A.

FIGS. 1A and 1B illustrate a heat pipe 1 as an example of a thermally conductive pipe according to a first exemplary embodiment. In the drawings such as FIGS. 1A and 1B, reference sign Ld indicates the longitudinal direction of the heat pipe 1, and reference sign Sd indicates the transverse direction that is a direction intersecting (actually orthogonal to) the longitudinal direction Ld of the heat pipe 1.

Thermally Conductive Pipe

The heat pipe 1, which is an example of a thermally conductive pipe, includes a pipe 10 having closed both end portions 10*a* and 10*b*, a working fluid 12 that is enclosed inside the pipe 10 and that is vaporized and liquefied, and a liquid transfer member 15 that extends in the longitudinal direction Ld inside the pipe 10 and that transfers the liquefied working fluid 12 in the longitudinal direction Ld.

The pipe 10 is a pipe having a hollow structure that is made of metal having a relatively high thermal conductivity, has a circular cross section, and is long in one direction. The shape of the circular cross section is not limited to a perfect circle, but includes a slightly distorted circle. The slightly distorted circle is, for example, a circle having a circularity of 200 μm or less. The closing form, structure, and the like of the end portions 10*a* and 10*b* of the pipe 10 are not particularly limited as long as the end portions 10*a* and 10*b* are sealed to such an extent that the working fluid 12 does not leak. One of the end portions 10*a* and 10*b* may have an end portion structure that is initially closed.

As such a pipe 10, a pipe suitable for the purpose of use is used. For example, from the viewpoint of making the cross-sectional area of the entire heat pipe 1 relatively small in the transverse direction Sd, a reduced-diameter cylindrical pipe having a circular shape in cross section with an outer diameter of 3 mm or less is used as an example of the pipe 10. The outer diameter of the pipe 10 may be, for example, 2 mm or more from the viewpoint of being able to be manufactured and securing the minimum strength.

The pipe 10 may be thinned such that the thickness thereof is in a range of 0.05 mm or more and 0.2 mm or less.

In the case where the diameter of the pipe 10 is reduced or the thickness of the pipe 10 is reduced as described above, the installation space and heat capacity of the pipe 10 are reduced, and the thermal conductivity of the pipe 10 is increased.

The pipe 10 may be formed of a metal material such as stainless steel or aluminum. For example, the pipe 10 may be made of oxygen-free copper (high purity copper of 99.96% or more containing almost no oxide) from the viewpoint of obtaining high thermal conductivity and ease of processing.

In a case where the surface of the pipe 10 may be oxidized, the surface may be subjected to an antioxidant treatment. Examples of the antioxidant treatment include plating, application of an antioxidant or the like, and coating.

The working fluid 12 is a medium that is vaporized (for example, evaporated) and liquefied (condensed) in accordance with a temperature distribution inside the pipe 10. A required amount of the working fluid 12 is enclosed inside the pipe 10.

In the first exemplary embodiment, for example, pure water is used as the working fluid 12. In FIGS. 1A, 1B, and the like, the working fluid 12 is illustrated in an exaggerated manner for the convenience of understanding.

The liquid transfer member 15 is a material capable of transferring the working fluid 12 liquefied inside the pipe 10 at least in the longitudinal direction Ld of the pipe 10. The liquefied working fluid 12 is transferred by the liquid transfer member 15 using a capillary force generated from a low-temperature region toward a high-temperature region having a relatively higher temperature than that of the low-temperature region in the pipe 10.

As the liquid transfer member 15, plural wires made of metal, a bundle of plural metal wires, a metal net formed by crossing plural metal wires into a net shape, sintered metal obtained by sintering metal powder, or the like is used. Among these, a bundle of plural metal wires is, for example, a bundle of twisted metal wires. The sintered metal may be sintered and attached to, for example, an inner wall surface of the pipe 10.

When the liquid transfer member 15 formed of plural wires is used, ultrafine wires each having an outer diameter of 0.06 mm or less may be used. The liquid transfer member 15 formed of the plural ultrafine wires has a larger surface area, thereby easily obtaining a capillary force. When a reduced-diameter pipe 10 having an outer diameter of 3 mm or less is used, the liquid transfer member 15 formed of extra-fine wires is effective because adjustment of the occupancy rate, which will be described later, is facilitated and the work for inserting the liquid transfer member 15 into the reduced-diameter pipe 10 is facilitated.

As illustrated in FIG. 1A, the liquid transfer member 15 is disposed inside the pipe 10 so as to extend in the longitudinal direction Ld.

As illustrated in FIG. 1B, the liquid transfer member 15 according to the first exemplary embodiment is disposed in contact with at least a portion of an inner wall surface 10*c* of the pipe 10 in the circumferential direction. As illustrated in FIG. 1A, the liquid transfer member 15 according to the first exemplary embodiment is also disposed in contact with a portion of the inner wall surface 10*c* of the pipe 10 in the longitudinal direction Ld.

In order to dispose the liquid transfer member 15 in contact with a portion of the inner wall surface 10*c* of the pipe 10, for example, it is possible to apply a method of fixing both end portions of the liquid transfer member 15 at positions at which both the end portions are maintained in contact with the inner wall surface 10*c* at the both end portions 10*a* and 10*b* of the pipe 10, or a method of sintering the liquid transfer member 15 with respect to the inner wall surface 10*c*.

In the heat pipe 1, from the viewpoint of improving the efficiency of circulating the working fluid 12 to obtain excellent thermal conductivity performance, for example, the occupancy rate (=(S2/S1)×100)) of a cross-sectional area S2 of the liquid transfer member 15 with respect to a cross-sectional area S1 of the inside of the pipe 10 in the transverse direction Sd is set in a range of 20% or more and 50 or less.

When the liquid transfer member 15 is formed of plural wires, the cross-sectional area S2 of the liquid transfer member 15 is the total area of the cross-sectional areas of the wires. When the liquid transfer member 15 is formed of sintered metal attached to the inner wall surface 10*c* of the pipe 10, the cross-sectional area S2 is the total area of the cross-sectional areas occupied by the sintered metal in the cross section of the pipe 10 in the transverse direction Sd of the pipe 10. The range of the occupancy rate is also derived from test results which will be described later.

When the occupancy rate of the heat pipe 1 is less than 20%, the heat pipe 1 less likely obtains the ability to move the liquefied working fluid 12 from the low-temperature region to the high-temperature region in the pipe 10 using the capillary force of the liquid transfer member 15.

In contrast, when the occupancy rate exceeds 50%, the heat pipe 1 no longer sufficiently secures a flow path (space) for moving the vaporized (for example, evaporated) working fluid 12 from the high-temperature region to the low-temperature region due to the atmospheric pressure difference in the pipe 10, and it is difficult to efficiently move the working fluid 12. When the occupancy rate exceeds 50%, as the diameter of the heat pipe 1 is reduced, it becomes difficult to insert the liquid transfer member 15 into the pipe 10 of the heat pipe 1 at that time.

The occupancy rate is more preferably in a range of, for example, 25% or more and 40% or less.

Next, a test performed to examine the thermal conductivity performance of the heat pipe 1 will be described.

Figure 2:
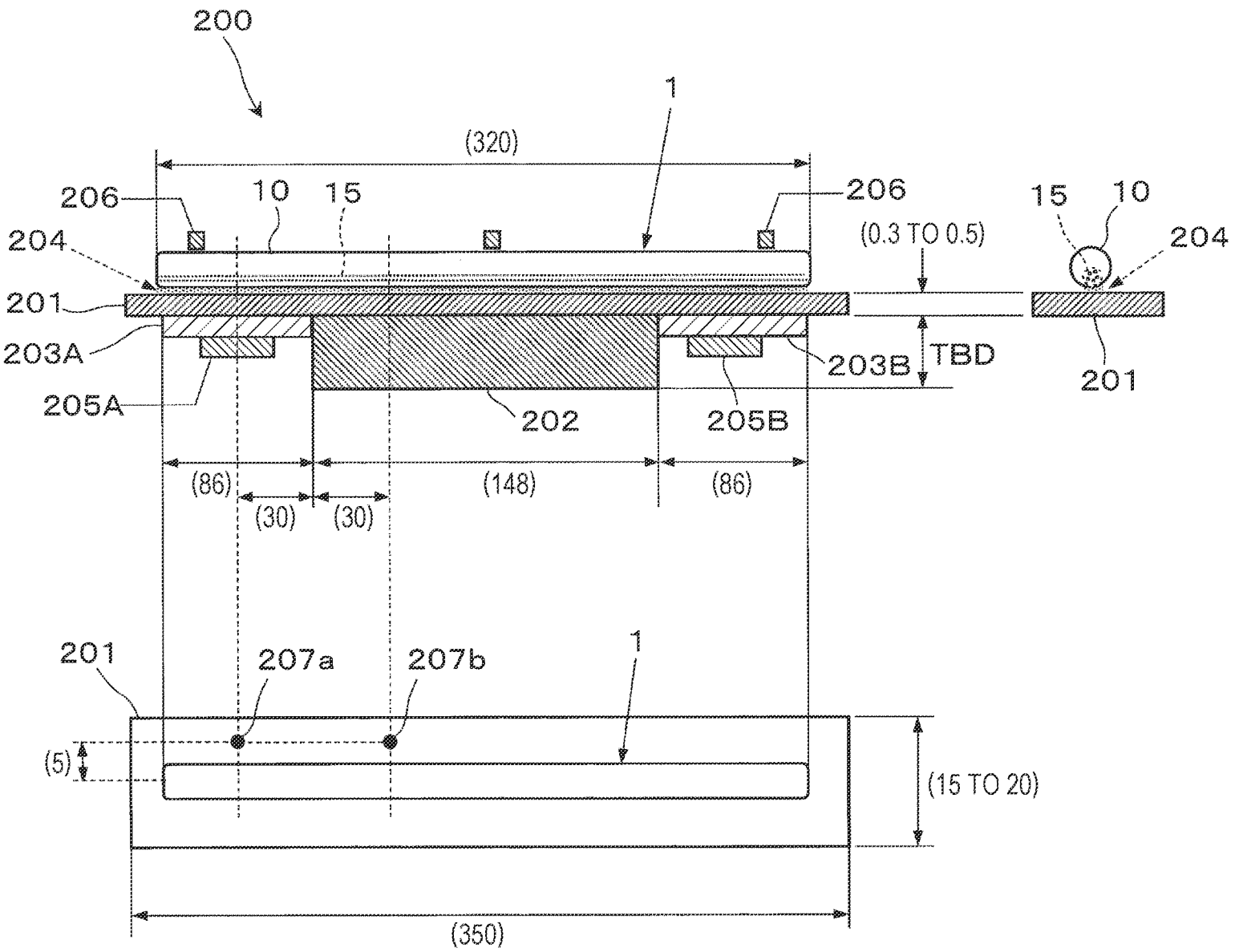
FIG. 2 is a schematic diagram illustrating a measurement apparatus used for an evaluation test in a state viewed from three directions.

In the test, plural heat pipes 1 having different occupancy rates are prepared, each heat pipe is installed in a measurement apparatus 200 illustrated in FIG. 2, and then the temperature difference between two points in the vicinity of the heat pipe when the measurement apparatus 200 is operated is measured as an evaluation index for the thermal conductivity performance.

Figure 3:
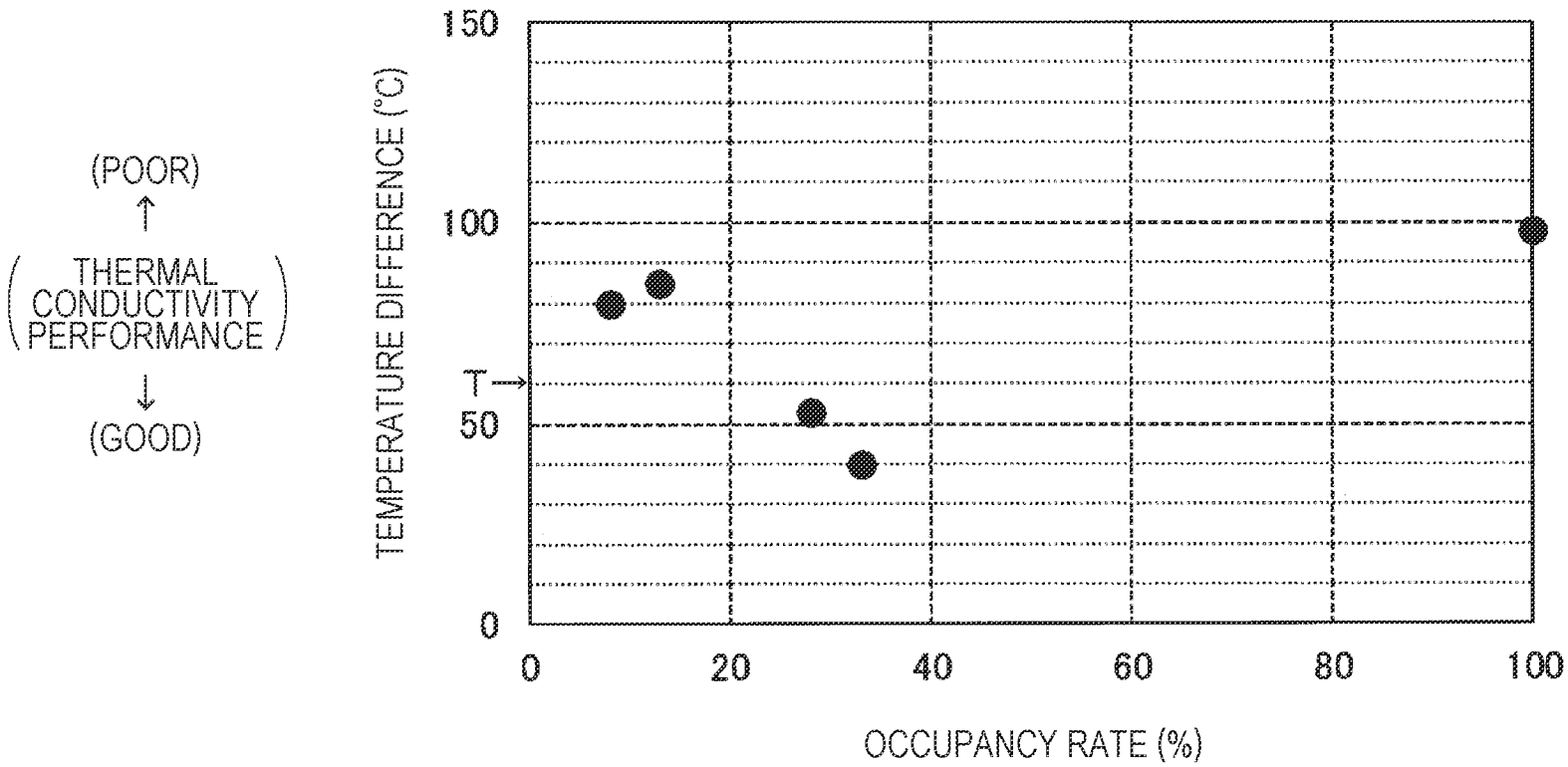
FIG. 3 is a graph presenting results of the evaluation test.

As the heat pipes, heat pipes are prepared in which various liquid transfer members 15 are disposed in oxygen-free copper pipes 10 (lengths in the longitudinal direction Ld are 320 mm) having circular sections with outer diameters in a range of 2 to 3 mm and thicknesses in a range of 0.05 to 0.20 mm so as to have occupancy rates indicated along the horizontal axis in FIG. 3.

Specifically, as the heat pipes 1, heat pipes having occupancy rates of the liquid transfer members 15 of 8%, 13%, 28%, 33%, and 100% are prepared. As illustrated in FIGS. 1A and 1B, each of the liquid transfer members 15 is disposed in contact with a portion of the corresponding pipe 10 extending in the longitudinal direction Ld and in contact with a portion of the inner wall surface 10*c* of the pipe 10. As the heat pipe having the occupancy rate of 100%, a copper wire having a solid structure having the same size as the pipe 10 is used.

As illustrated in FIG. 2, the measurement apparatus 200 includes a measurement table 201 made of a rectangular aluminum plate, a radiating plate 202 made of aluminum and disposed at a central portion of the lower surface of the measurement table 201, heating plates 203A and 203B made of aluminum and disposed on both end sides in the longitudinal direction adjacent to the radiating plate 202 on the lower surface of the measurement table 201, heaters (planar heaters) 205A and 205B disposed on the lower surfaces of the heating plates 203A and 203B, pressing members 206 that press the heat pipe 1 and the like against the measurement table 201 to hold the heat pipe 1, and thermocouples 207*a* and 207*b* that measure temperature. The numerical values in parentheses in FIG. 2 indicate the dimensions (mm) of the above-described components.

The radiating plate 202 and the heating plate 203 are the same aluminum plates except that the thickness (TBD: 100 mm) of the radiating plate 202 is larger than that of the heating plate 203.

In this test, measurement is performed as follows.

First, as illustrated in FIG. 2, the heat pipe 1 to be measured is prepared by being installed on the measurement table 201 of the measurement apparatus 200 in a state of facing the measurement table 201 in a posture in which the liquid transfer member 15 is located at the lowermost portion of the pipe 10. At this time, the heat pipe 1 is held on the measurement table 201 via grease 204 having thermal conductivity. As the grease 204, for example, grease having a thermal conductivity of 1 to 10 W/m/K is used.

Next, the outputs of the heaters 205A and 205B are adjusted to obtain a first measurement temperature of the inner thermocouple 207*b* located inside an end portion of the measurement table 201 when the measurement temperature by the outer thermocouple 207*a* located on the end portion side of the measurement table 201 stabilizes at a first test temperature of 150° C.

The outputs of the heaters 205A and 205B are adjusted to obtain a second measurement temperature of the inner thermocouple 207*b* when the measurement temperature by the outer thermocouple 207*a* stabilizes at a second test temperature of 230° C.

The average of the temperature difference between the first test temperature and the first measurement temperature and the temperature difference between the second test temperature and the second measurement temperature in one heat pipe 1 is obtained as the temperature difference (characteristics) of the measured heat pipe 1.

FIG. 3 illustrates measurement results of the heat pipes 1 having the above-described occupancy rates. The smaller the value of the temperature difference, the better the thermal conduction. A temperature difference T of an allowable level may be, for example, 60° C. or less.

From the results illustrated in FIG. 3, the heat pipes satisfying the temperature difference T of the allowable level of 60° C. or less are the heat pipes in which the occupancy rates of the liquid transfer members 15 are 28% and 33%. In contrast, in the case of the heat pipes in which the occupancy rates of the liquid transfer members 15 are 8%, 13%, and 100%, the temperatures do not become equal to or lower than 60° C. that is the temperature difference T of the allowable level.

In addition, as the temperature difference measured in this test decreases, the temperature difference between the portion heated by the heater 205A or the like and the inner non-heated portion adjacent to the heated portion tends to decrease due to good heat transfer (heat transportation) by the heat pipe, which may indicate that the thermal conductivity performance is good. In contrast, as the measured temperature difference increases, the heat transfer by the heat pipe is not sufficiently performed, which may indicate that the thermal conductivity performance is relatively poor. That is, there may be a correlation that the magnitude of the temperature difference measured in this test indicates good or poor of the thermal conductivity performance.

Thus, it is found from this test that the heat pipe 1 in which the occupancy rate of the liquid transfer member 15 is 20% or more and 50% or less may obtain excellent thermal conductivity performance.

Modification of First Exemplary Embodiment

Figure 4A:
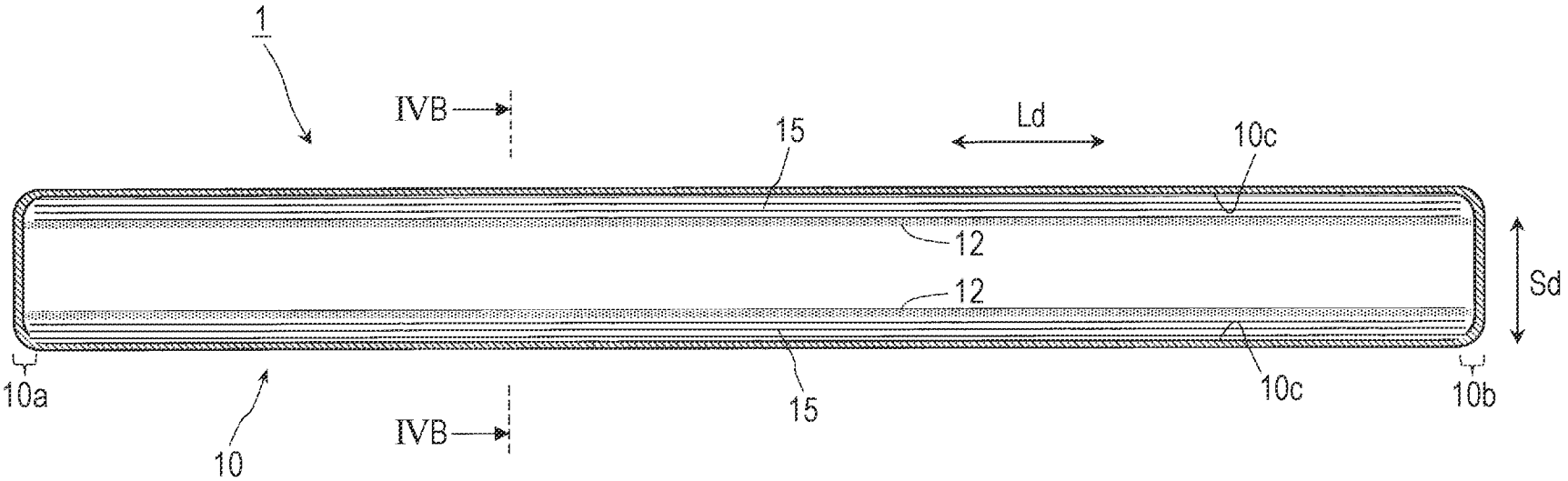
FIG. 4A is a schematic sectional view taken in the longitudinal direction of a thermally conductive pipe according to a modification of the first exemplary embodiment.
Figure 4B:
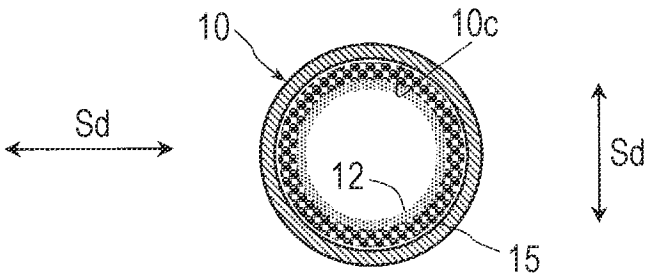
FIG. 4B is a schematic sectional view taken along line IVB-IVB of the thermally conductive pipe of FIG. 4A.

In the heat pipe 1 according to the first exemplary embodiment, as illustrated in FIGS. 4A and 4B, the liquid transfer member 15 may be disposed in contact with the entire region of the inner wall surface 10*c* of the pipe 10. The contact with the entire region of the inner wall surface 10*c* is not limited to a case where the liquid transfer member 15 is completely in contact with the entire region of the inner wall surface 10*c*, but also includes a case where a portion of the liquid transfer member 15 is close to the inner wall surface 10*c* but is slightly separated to be in a non-contact state.

At this time, the liquid transfer member 15 is disposed so as to extend also in the longitudinal direction Ld inside the pipe 10. As the liquid transfer member 15, plural wires made of metal and disposed side by side, a metal net formed by crossing plural metal wires into a net shape, sintered metal obtained by sintering metal powder, or the like is used.

The heat pipe 1 according to this modification is also configured such that the occupancy rate of the cross-sectional area S2 of the liquid transfer member 15 with respect to the cross-sectional area S1 of the inside of the pipe 10 in the transverse direction Sd is in a range of 20% or more and 50% or less.

Figure 5A:
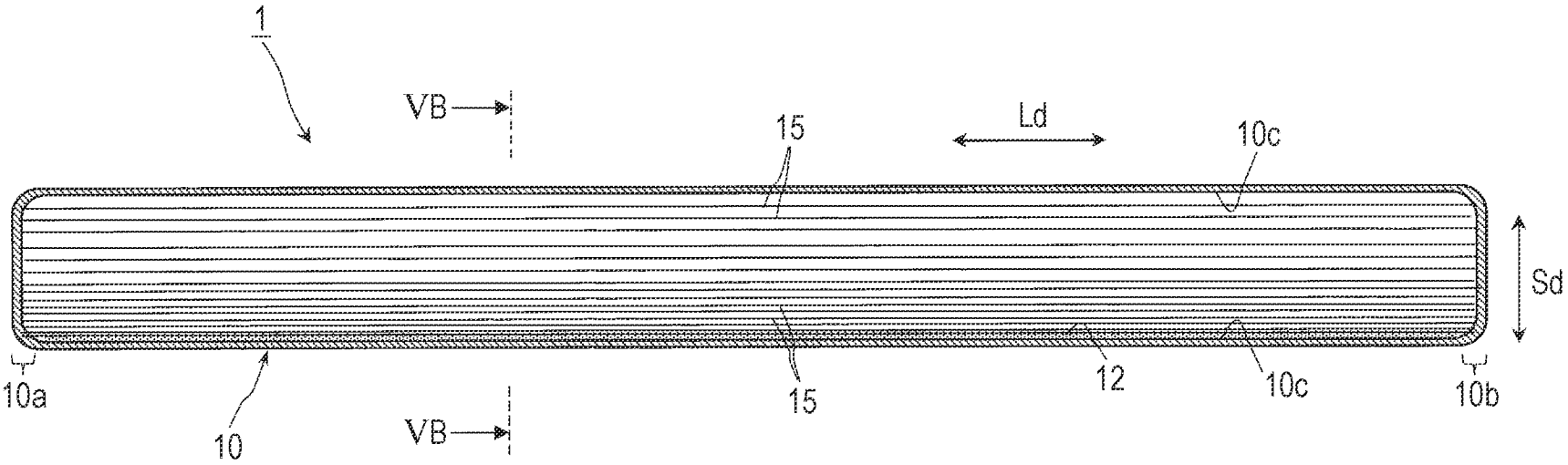
FIG. 5A is a schematic sectional view taken in the longitudinal direction of a thermally conductive pipe according to a modification of the first exemplary embodiment.
Figure 5B:
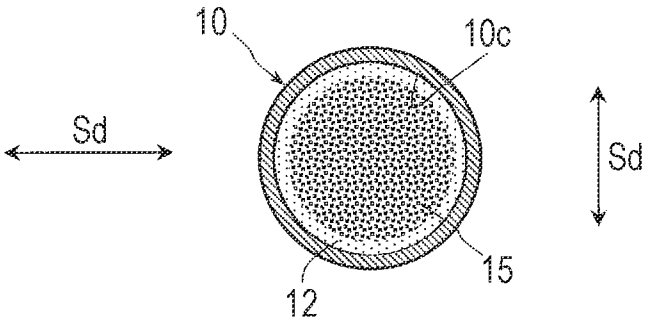
FIG. 5B is a schematic sectional view taken along line VB-VB of the thermally conductive pipe of FIG. 5A.

As illustrated in FIGS. 5A and 5B, the heat pipe 1 according to first exemplary embodiment may be disposed such that the liquid transfer member 15 is substantially not in contact with the inner wall surface 10*c* of the pipe 10. The state in which the liquid transfer member 15 is substantially not in contact with the inner wall surface 10*c* is not limited to a case where the liquid transfer member 15 is not in contact with the inner wall surface 10*c* at all, but also includes a case where a portion of the liquid transfer member 15 is in contact with a portion of the inner wall surface 10*c*.

At this time, the liquid transfer member 15 is disposed so as to extend also in the longitudinal direction Ld inside the pipe 10. As the liquid transfer member 15, for example, plural wires made of metal and disposed side by side, a bundle of plural metal wires, a metal net formed by crossing plural metal wires into a net shape, or the like is used.

The heat pipe 1 according to this modification is also configured such that the occupancy rate of the cross-sectional area S2 of the liquid transfer member 15 with respect to the cross-sectional area S1 of the inside of the pipe 10 in the transverse direction Sd is in the range of 20% or more and 50% or less.

Second Exemplary Embodiment

Figure 6:
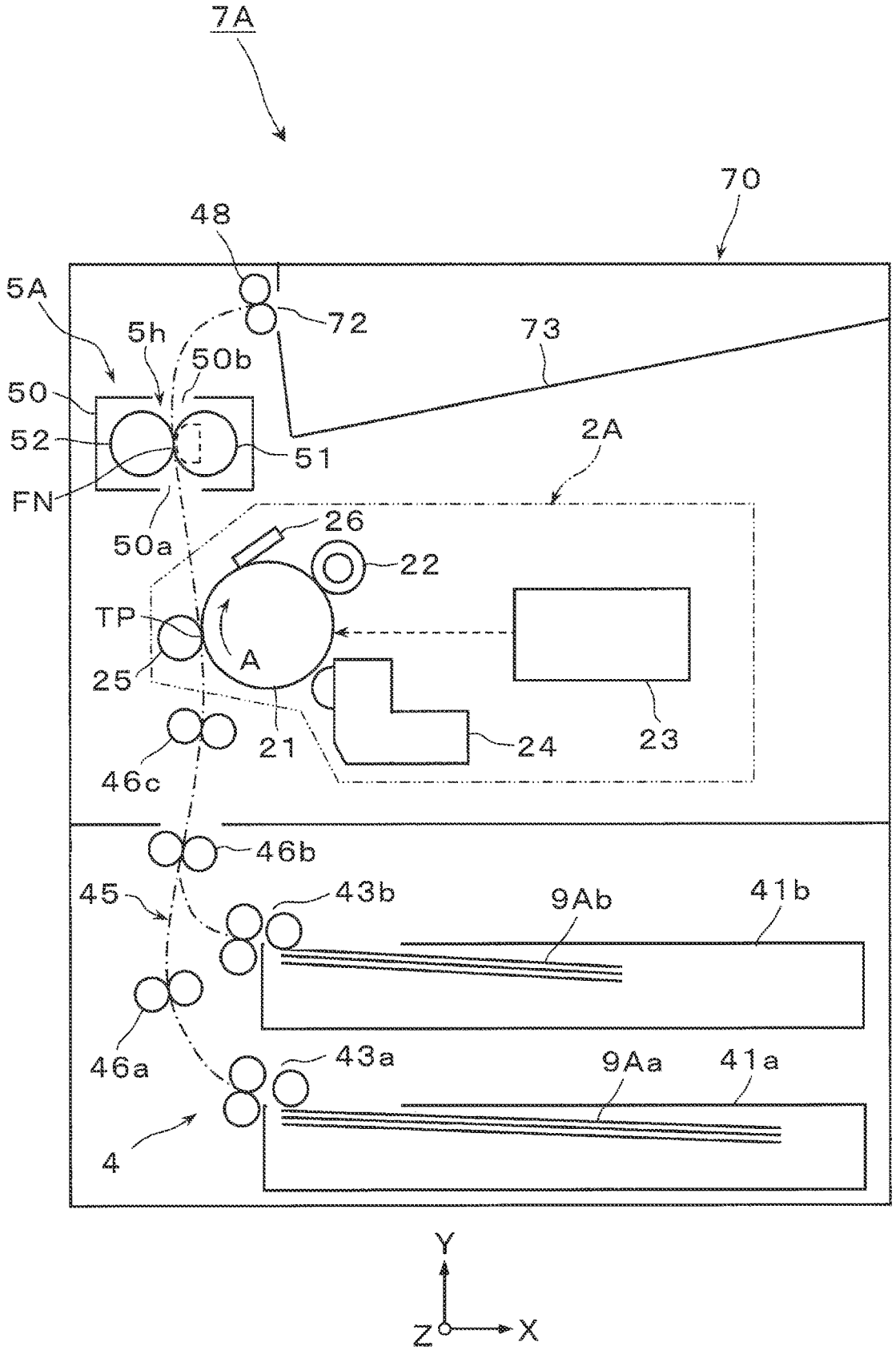
FIG. 6 is a schematic diagram illustrating the inside of a processing system according to a second exemplary embodiment.
Figure 7:
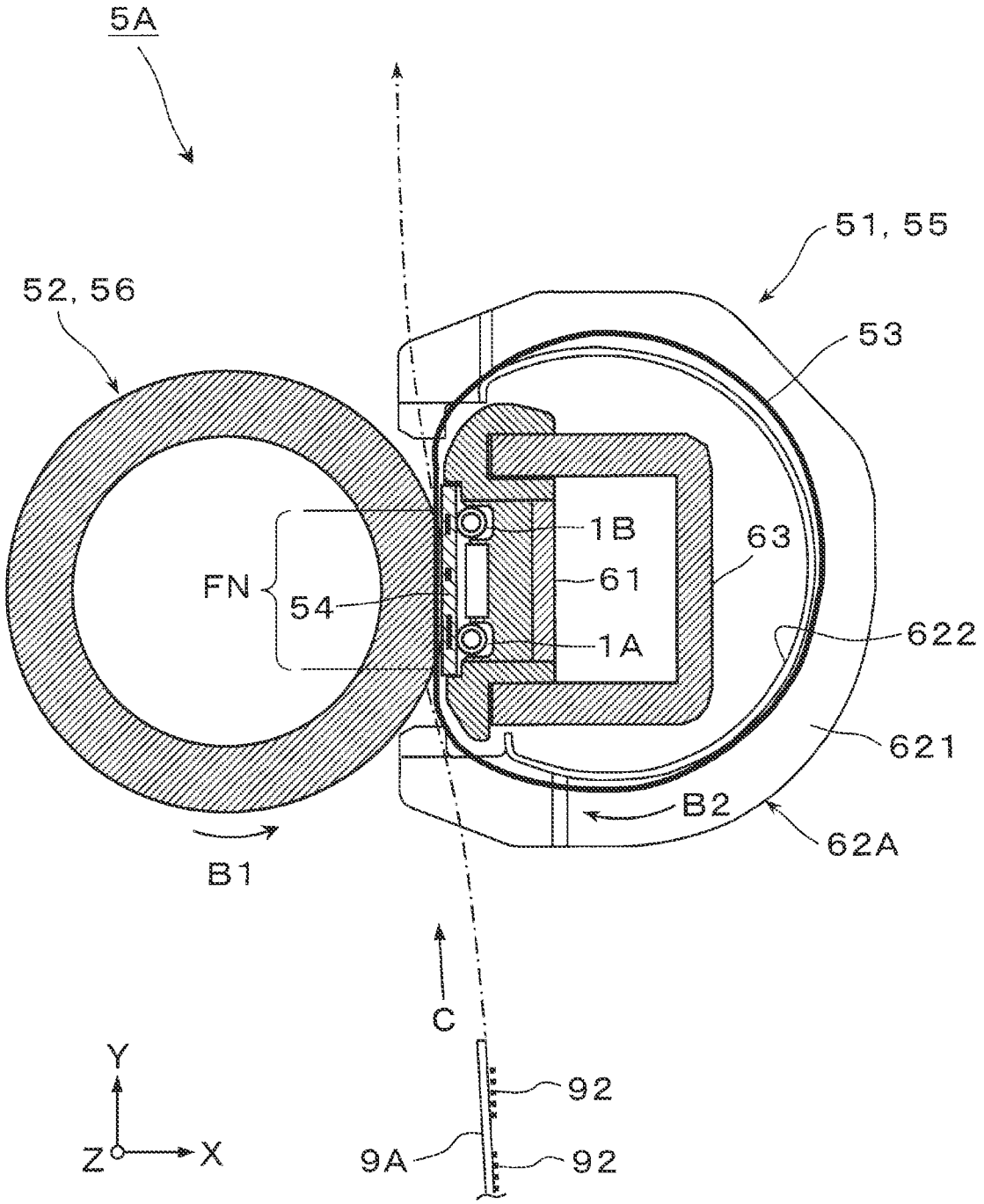
FIG. 7 is a schematic diagram illustrating the inside of a thermal processing device according to the second exemplary embodiment.

FIGS. 6 and 7 illustrate a configuration example according to a second exemplary embodiment. FIG. 6 illustrates a processing system 7 according to the second exemplary embodiment, and FIG. 7 illustrates a thermal processing device 5 according to the second exemplary embodiment.

In the following description, the direction indicated by arrow X in the drawings is the width direction of the apparatus, the direction indicated by arrow Y is the height direction of the apparatus, and the direction indicated by arrow Z is the depth direction orthogonal to the width direction and the height direction. A circle attached to the intersection of arrows X and Y in the drawing indicates that the depth direction (arrow Z) of the apparatus is directed downward orthogonal to the drawing.

The processing system 7 includes a thermal processing device 5 having a thermal processor that performs thermal processing of heating or cooling a processing target object 9 passing in contact with the thermal processor, and another processing apparatus 2 that performs another processing other than the thermal processing on the processing target object 9 before or after passing through the thermal processing device 5.

The thermal processing device 5 includes a thermal processor 5*h* that performs thermal processing of heating or cooling a processing target object 9 passing in contact with the thermal processor 5*h*, and a thermally conductive pipe 1 installed in a portion of the thermal processor 5*h* where a temperature difference in a passage width direction Wd of the processing target object 9 is to be suppressed.

In the second exemplary embodiment, an image forming apparatus 7A that performs processing of forming an image on a processing target object 9 is applied as an example of the processing system 7. In the second exemplary embodiment, since the processing system 7 is the image forming apparatus 7A, a heating device 5A including a thermal processor that performs thermal processing of heating a processing target object 9, as an example of the thermal processing device 5, an imaging device 2A that performs imaging on the processing target object 9 before passing through the heating device 5A, as an example of the other processing device 2, and a recording sheet 9A on which an image is formed, as an example of the processing target object 9, are applied.

Processing System

The image forming apparatus 7A as an example of the processing system 7 is an apparatus that forms an image by forming an image formed of a developer as an example of powder on a recording sheet 9A and then heating and fixing the image.

As illustrated in FIG. 6, the image forming apparatus 7A includes a housing 70 having a certain external shape. The imaging device 2A, a sheet feed device 4, the heating device 5A, and the like are disposed in an internal space of the housing 70. A one-dot chain line in FIG. 6 indicates a major transport path when a recording sheet 9A is transported in the housing 70.

The imaging device 2A is a device that forms a toner image formed of a toner as a developer and transfers the toner image to a recording sheet 9A. The imaging device 2A includes a photoreceptor drum 21 that rotates in a direction indicated by arrow A. Devices such as a charging device 22, an exposure device 23, a developing device 24, a transfer device 25, and a cleaning device 26 are disposed around the photoreceptor drum 21.

Among these, the photoreceptor drum 21 is an example of an image holder, and is a drum-shaped photoreceptor having a photosensitive layer serving as an image formation surface and an image holding surface. The charging device 22 is a device that charges the outer peripheral surface (image formation surface) of the photoreceptor drum 21 to a predetermined surface potential. The charging device 22 includes, for example, a charging member having a roll shape or the like which is brought into contact with the image formation surface on the outer peripheral surface of the photoreceptor drum 21 and to which a charging current is supplied.

The exposure device 23 is a device that forms an electrostatic latent image by performing exposure to light based on image information on the charged outer peripheral surface of the photoreceptor drum 21. The exposure device 23 operates by receiving an image signal generated by an image processor (not illustrated) or the like performing predetermined processing on image information input from the outside. The image information is, for example, information on an image to be formed, such as a character, a figure, a photograph, or a pattern. The developing device 24 is a device that develops the electrostatic latent image formed on the outer peripheral surface of the photoreceptor drum 21 with a developer (toner) of a corresponding predetermined color (for example, black) to visualize the electrostatic latent image as a monochromatic toner image.

Next, the transfer device 25 is a device that electrostatically transfers the toner image formed on the outer peripheral surface of the photoreceptor drum 21 to a recording sheet 9A. The transfer device 25 includes, for example, a transfer member having a roll shape or the like which is brought into contact with the outer peripheral surface of the photoreceptor drum 21 and to which a transfer current is supplied. The cleaning device 26 is a device that cleans the outer peripheral surface of the photoreceptor drum 21 by removing unnecessary substances such as unnecessary toner and paper dust adhering to the outer peripheral surface of the photoreceptor drum 21.

In the imaging device 2A, an area in which the photoreceptor drum 21 and the transfer device 25 face each other is a transfer position TP at which the toner image is transferred.

The sheet feed device 4 is a device that houses and sends a recording sheet 9A to be fed to the transfer position TP in the imaging device 2A. The sheet feed device 4 is configured by disposing one or plural housing bodies 41 that house recording sheets 9A and devices such as one or plural sending devices 43 that send out the recording sheets 9A.

The housing bodies 41 are each a housing member having a stack plate (not illustrated) on which plural recording sheets 9A are stacked and housed in a predetermined direction. The sending devices 43 are each a device that feeds the recording sheets 9A stacked on the stacking plate of the corresponding housing body 41 one by one by a device such as plural rolls. The sheet feed device 4 according to the second exemplary embodiment includes, for example, two housing bodies 41*a* and 41*b* capable of respectively housing recording sheets 9Aa and recording sheets 9Ab having different widths at the time of transport, and two sending devices 43*a* and 43*b* that respectively send out the recording sheets 9Aa and the recording sheets 9Ab housed in the housing bodies 41*a* and 41*b*.

The sheet feed device 4 is connected to the transfer position TP in the imaging device 2A by a feed transport path 45 as an example of a transporting section. The feed transport path 45 is a transport path along which a recording sheet 9A (9Aa or 9Ab) sent out from the sheet feed device 4 is transported and fed to the transfer position TP, and is configured by disposing plural transport rollers 46*a* to 46*c* that sandwich and transport the recording sheet 9A, and plural guide members (not illustrated) that secure a transport space for the recording sheet 9A and guide the transport of the recording sheet 9A.

The recording sheet 9A may be any sheet-shaped recording medium that is able to be transported in the housing 70 and to which a toner image is able to be transferred and thermally fixed. The material, form, and the like of the recording sheet 9A are not particularly limited.

The heating device 5A is a device that performs processing of applying heat and pressure to thermally fix, to the recording sheet 9A, the toner image of an unfixed image transferred at the transfer position TP of the imaging device 2A. The heating device 5A is configured such that devices such as a heating rotary body 51 and a pressing rotary body 52 are disposed in an internal space of a housing 50 having an inlet 50*a* and an outlet 50*b* for the recording sheet 9A.

In the heating device 5A, as illustrated in FIGS. 6 and 7, the heating rotary body 51 and the pressing rotary body 52 are disposed to rotate in contact with each other, and apply heat and pressure to a recording sheet 9A or the like passing through a contact portion FN at which the heating rotary body 51 and the pressing rotary body 52 contact each other. In the heating device 5A, a portion constituted by the heating rotary body 51 and the pressing rotary body 52 is the thermal processor 5*h*.

Details of the heating device 5A will be described later.

In the image forming apparatus 7A, an image is formed, for example, as follows.

For example, in the image forming apparatus 7A, when a controller (not illustrated) receives an instruction for an operation of forming an image, the imaging device 2A executes a charging operation, an exposure operation, a developing operation, and a transfer operation, and the sheet feed device 4 executes an operation of sending out a predetermined recording sheet 9A (9Aa or 9Ab) and transporting and feeding the recording sheet 9A to the transfer position TP via the feed transport path 45.

Thus, a toner image corresponding to image information is formed on the photoreceptor drum 21, and the toner image is transferred to the recording sheet 9A fed from the sheet feed device 4 to the transfer position TP. At this time, the recording sheet 9A to which the toner image has been transferred is separated from the photoreceptor drum 21 in a state of being sandwiched between the rotating photoreceptor drum 21 and the transfer device 25, and is sent out toward the heating device 5A.

Subsequently, in the heating device 5A of the image forming apparatus 7A, as illustrated in FIG. 7, a fixing operation is executed in which heating and pressing are performed on the recording sheet 9A when the recording sheet 9A to which a toner image 92 has been transferred is introduced into and passes through the above-described contact portion FN. Thus, the unfixed toner image 92 is molten under pressure and fixed to the recording sheet 9A. In this case, the heating rotary body 51 and the pressing rotary body 52 function as a transporting section that transports the recording sheet 9A.

The recording sheet 9A after the fixing is output from the housing 50 in a state of being sandwiched between the heating rotary body 51 and the pressing rotary body 52 in the heating device 5A, then is transported to an outlet 72 via an output transport path, and finally is sent out and housed in a sheet housing portion 73 provided in a portion of the housing 70 by an output roll 48.

Thus, a basic image forming operation of the image forming apparatus 7A to form a monochromatic image on one side of a recording sheet 9A is completed.

Thermal Processing Device

Next, the heating device 5A as an example of the thermal processing device 5 will be described in detail.

Figure 8:
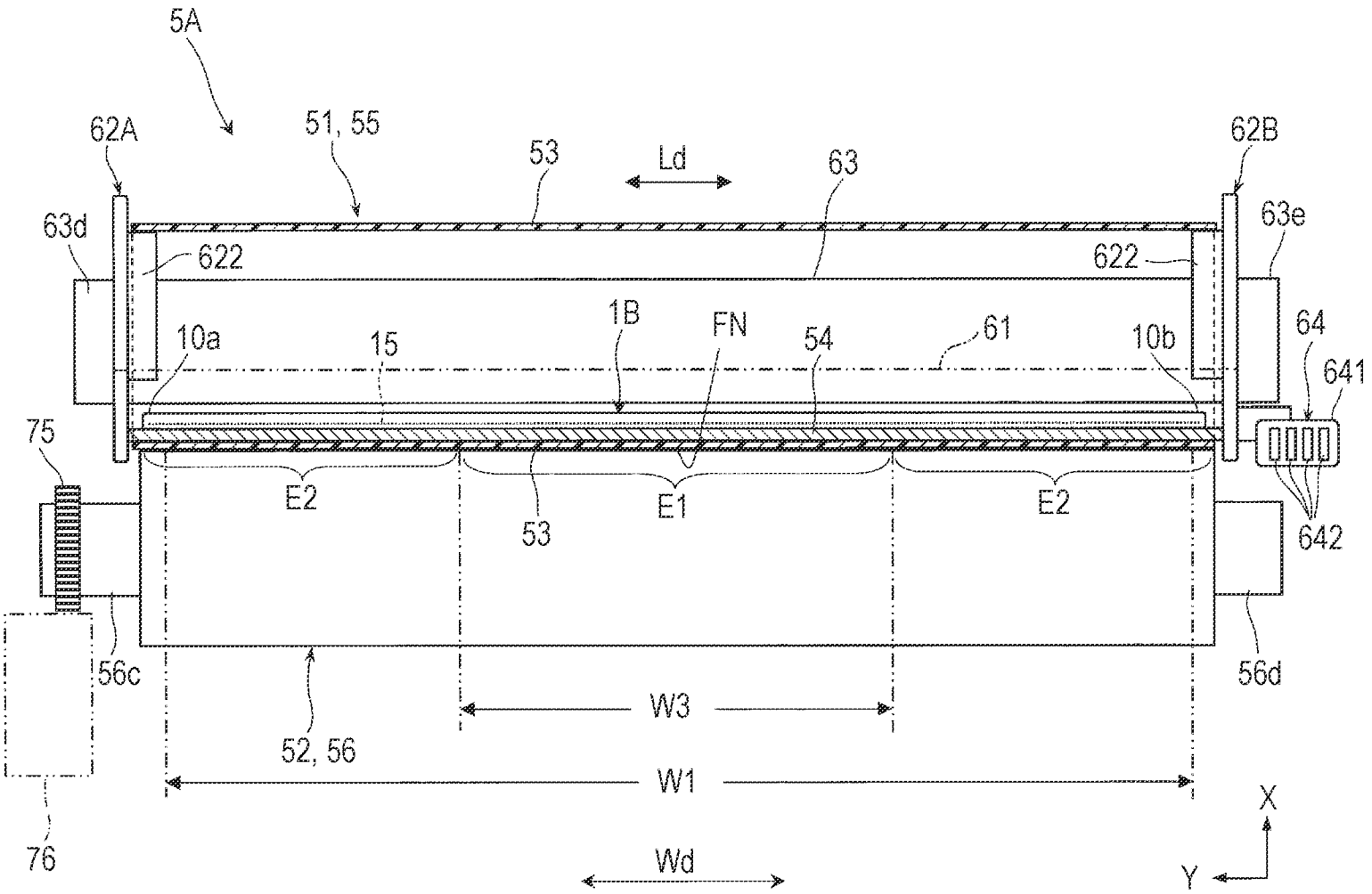
FIG. 8 is a schematic partly sectioned view illustrating the thermal processing device of FIG. 7 in a state viewed from another direction.

As illustrated in FIGS. 7, 8, and the like, the heating device 5A according to the second exemplary embodiment employs, as the heating rotary body 51, a belt-nip-form heating unit 55 including a rotatable heating belt 53 and a heat generating body 54 as an example of a heating section that generates heat so as to form the contact portion (nip) FN at which the heating belt 53 is pressed against and contacts the pressing rotary body 52 from the inner peripheral surface thereof, and employs a pressure roll 56 in a roll shape as the pressing rotary body 52.

The heating unit 55 performs thermal processing of heating a recording sheet 9A at the contact portion FN at which the heating unit 55 is in contact in the passage width direction Wd (FIG. 8 and the like) intersecting a transport direction C of the recording sheet 9A.

The heating unit 55 holds the heat generating body 54 in contact with the inner peripheral surface of the heating belt 53 by a contact holder 61 and rotatably holds the heating belt 53 by a portion of the contact holder 61 and left and right end-portion holders 62A and 62B. The heating unit 55 supports the contact holder 61 and the left and right end-portion holders 62A and 62B by a support 63.

The heating belt 53 is an endless belt for thermal conduction having flexibility and heat resistance. As the heating belt 53, for example, a belt molded into, as an original shape thereof, a cylindrical shape with a material such as a synthetic resin which is polyimide, polyamide, or the like is applied.

Figure 9A:
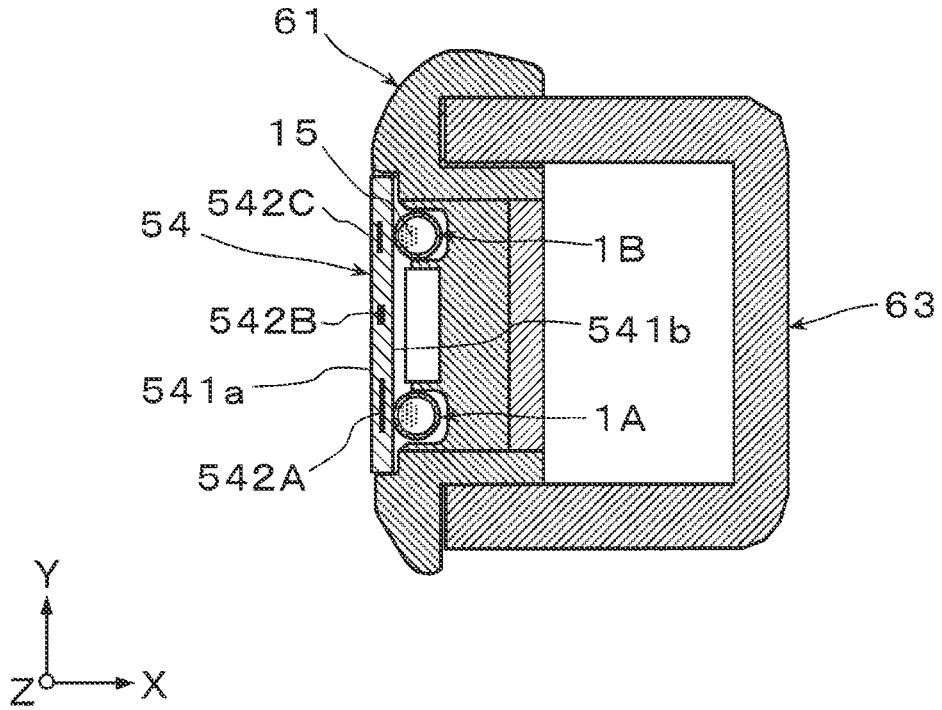
FIG. 9A is a schematic sectioned view illustrating a portion of a heating unit applied to the thermal processing device of FIG. 7.
Figure 9B:
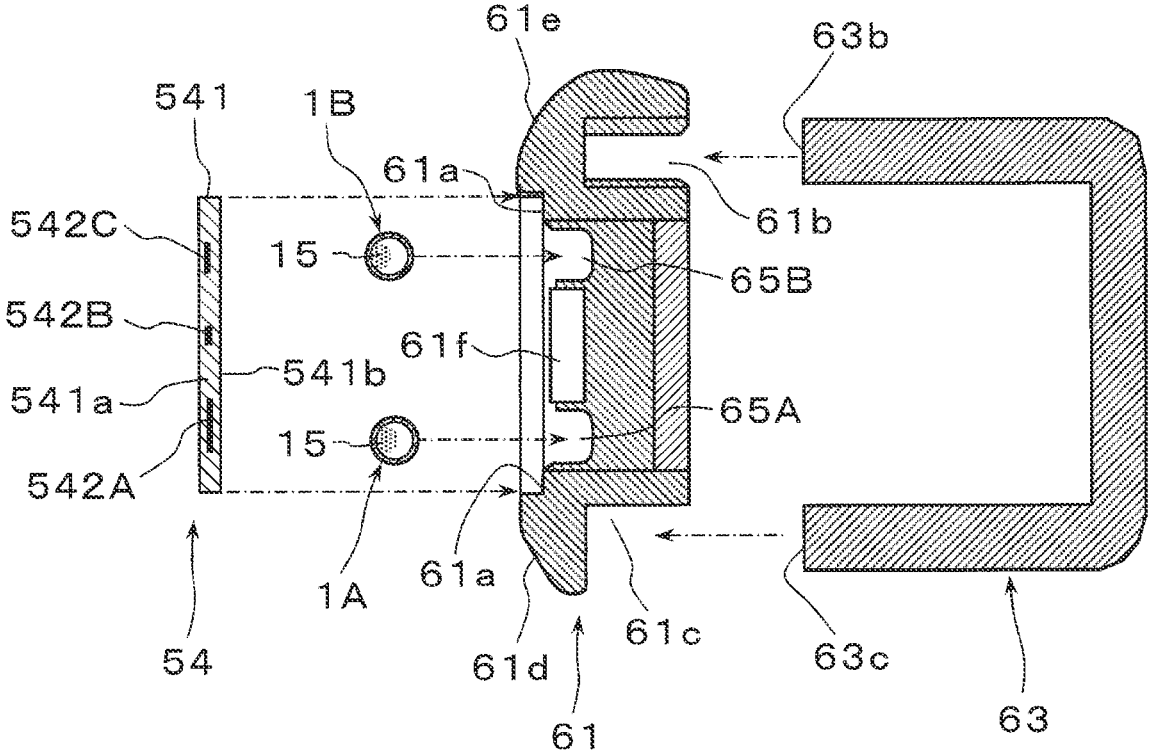
FIG. 9B is an exploded view of the heating unit of FIG. 9A.
Figure 10:
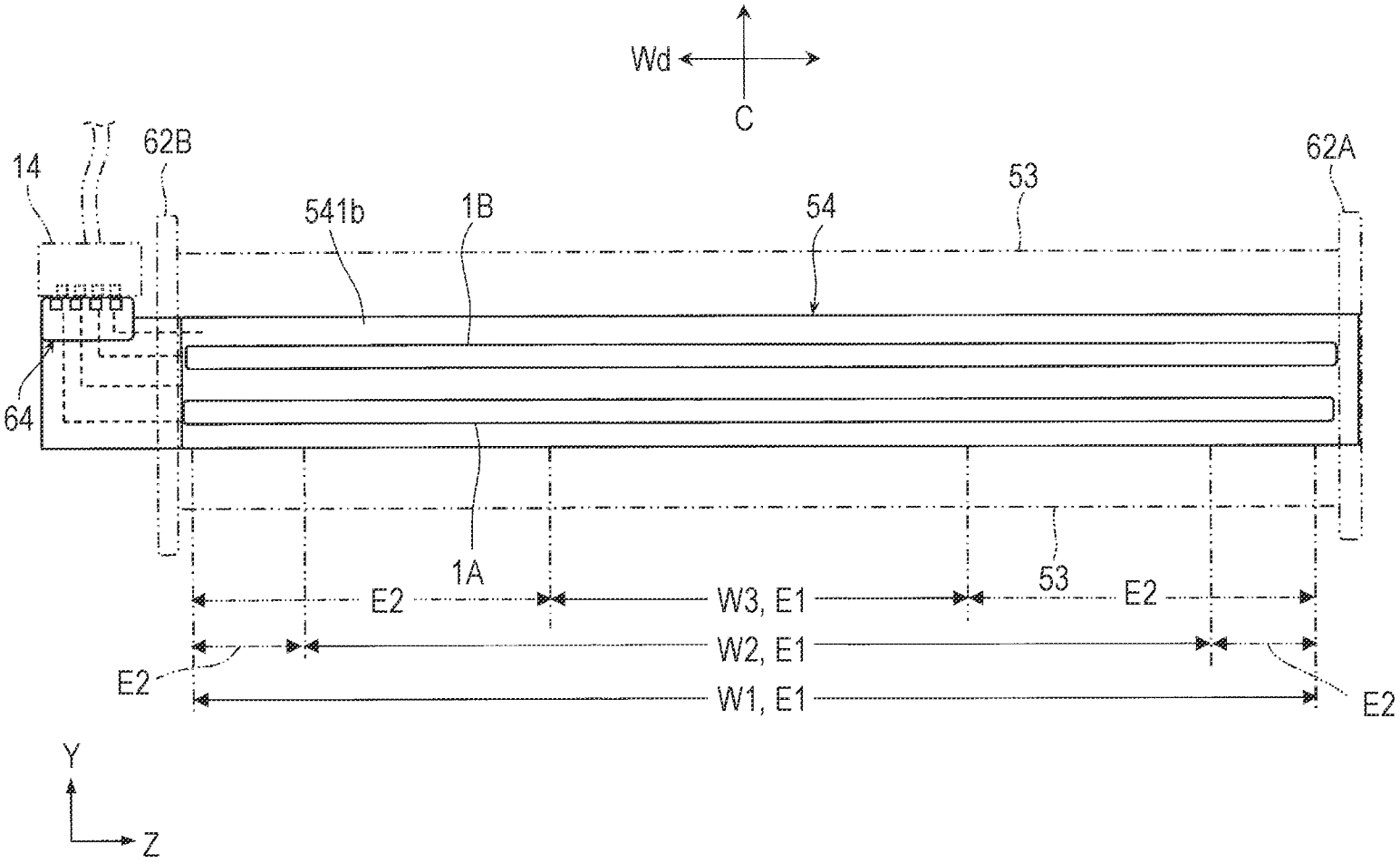
FIG. 10 is a schematic diagram illustrating a portion of the thermal processing device of FIG. 7.

As illustrated in FIGS. 9A, 9B, 10, and the like, the heat generating body 54 includes a substrate 541, plural (3 in this example) heat generating portions 542A, 542B, and 542C provided on one surface 541*a* of the substrate 541 which contacts the inner peripheral surface of the heating belt 53, and a wiring portion 543 for supplying power to the heat generating portions 542A, 542B, and 542C.

The substrate 541 is a plate-shaped member having a rectangular shape with a larger width size W in the passage width direction Wd intersecting the transport direction C of a recording sheet 9A than a maximum width size W1 of the recording sheet 9A. The substrate 541 is made of an electrically insulating material. For example, a ceramic substrate is applied as the substrate 541. The surface (one surface) 541*a* of the substrate 541 which contacts the inner peripheral surface of the heating belt 53 is coated with a coating layer formed thereon after the heat generating portions 542A, 542B, and 542C are provided.

Figure 11A:
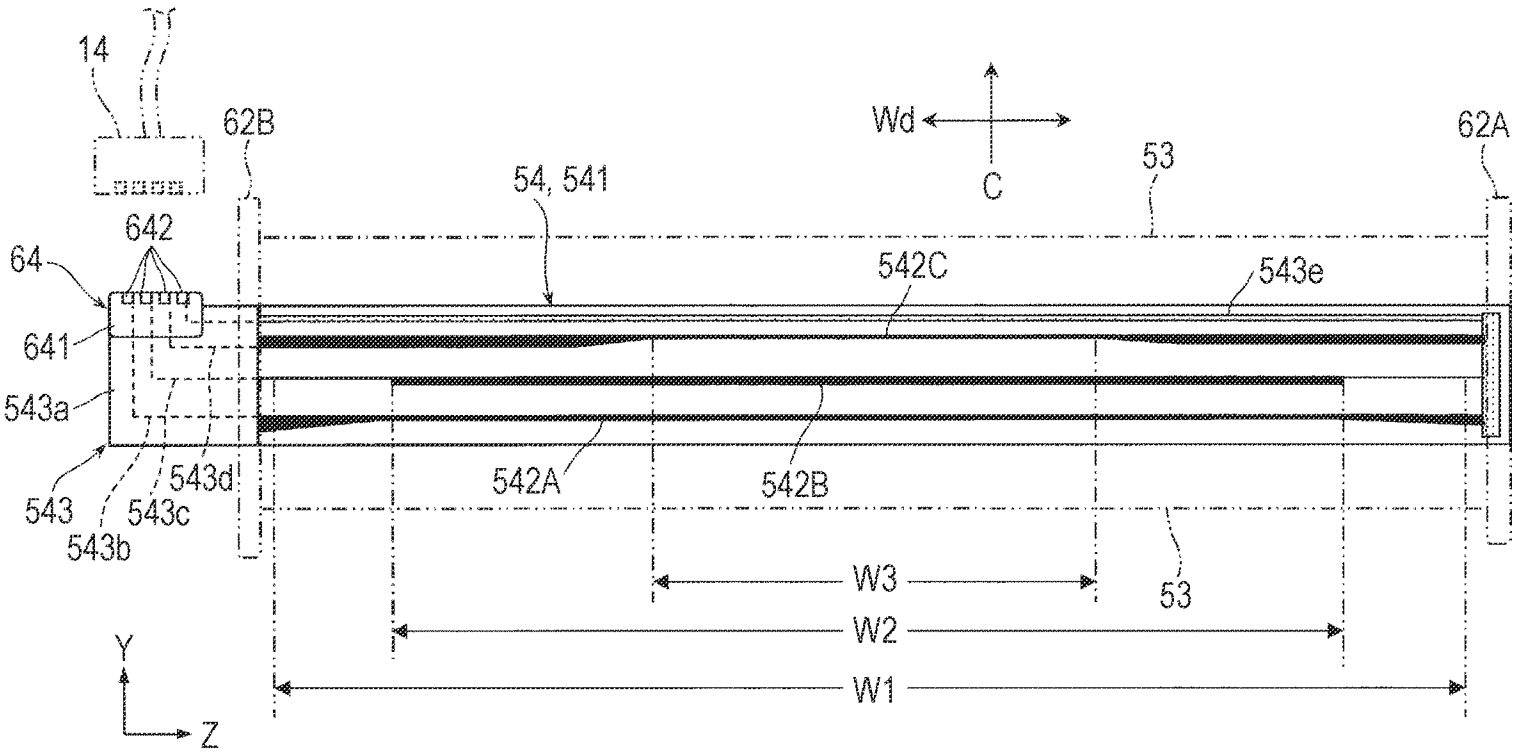
FIG. 11A is a schematic diagram illustrating a portion of the heating unit.

As illustrated in FIG. 11A, the heat generating portions 542A, 542B, and 542C are heating wire portions linearly provided on the one surface 541*a* of the substrate 541 to extend in the longitudinal direction (the direction extending in the passage width direction Wd of the recording sheet 9A) and to be separate from each other in the passage width direction Wd of the recording sheet 9A, thereby being in a parallel state.

Since FIG. 11A is a drawing illustrating a state viewed from a back surface (the other surface) 541*b* opposite to the one surface 541*a* of the substrate 541 of the heat generating body 54, the heat generating portion 542 provided on the one surface 541*a* is not actually visible. However, for the convenience of describing the heat generating portion 542, FIG. 11A illustrates the heat generating portion 542 in a state seen through from the other surface 541*b*.

The heat generating portions 542A, 542B, and 542C have substantially the same length in the longitudinal direction of the substrate 541, but are configured such that regions where relatively large amounts of heat are generated are present at positions different from each other so as to conform to the difference in width size W when a recording sheet 9A is transported.

That is, for example, as illustrated in FIG. 11A, the first heat generating portion 542A is configured such that a central portion excluding end portions on both end sides in the longitudinal direction is a region where a large amount of heat is generated. The first heat generating portion 542A is used when a recording sheet 9A having a width size W of an intermediate width size W2 (<W1) passes. The second heat generating portion 542B is configured such that portions corresponding to end portions on both end sides of the first heat generating portion 542A are regions where a large amount of heat is generated. The third heat generating portion 542C is configured such that a central portion in the longitudinal direction (for example, a portion of about ⅓ of the total length) is a region where a large amount of heat is generated. The third heat generating portion 542C is used when a recording sheet 9A having a width size W of a minimum size W3 (<W2) passes.

The configuration of the regions where the heat generating portions 542A, 542B, and 542C generate relatively large amounts of heat in the second exemplary embodiment is a configuration in a case where a center reference transport method (center registration method) is employed. With the method, a recording sheet 9A is guided and transported such that the center position in the passage width direction Wd when the recording sheet 9A is transported passes through, for example, a reference center position of the passage region width of the recording sheet 9A in the contact portion FN of the heating device 5A.

The regions where the heat generating portions 542A, 542B, and 542C generate relatively large amounts of heat are each provided, for example, by making at least one of the width and the thickness or both of the heating wire portion smaller than those of the other portion (portion where heat generation is suppressed) so that the electric resistance value becomes relatively high.

The temperature of the heat generating body 54 due to the heat generated by the heat generating portions 542A, 542B, and 542C is measured by a temperature sensor (not illustrated) disposed in contact with a certain location on the other surface 541*b* of the substrate 541 of the heat generating body 54, and the measurement information is fed back to a heating controller (not illustrated).

As illustrated in FIG. 11A and the like, the wiring portion 543 is provided such that a line concentration portion thereof is present at one end portion in the longitudinal direction of the heat generating body 54 and at a position outside one of the end-portion holders 62A and 62B. The wiring portion 543 according to the second exemplary embodiment is configured as an end portion obtained by extending one end portion of the substrate 541 to the outside of the right end-portion holder 62B.

The wiring portion 543 includes an electrically insulating substrate 543*a*, individual wiring portions 543*b*, 543*c*, and 543*d* individually connected to one end portions of the heat generating portions 542A, 542B, and 542C as indicated by broken lines in FIG. 11A, and a common wiring portion 543*e* connected in a manner common to the other end portions of the heat generating portions 542A, 542B, and 542C as indicated by dotted lines and broken lines in FIG. 11A.

As illustrated in FIG. 8 and the like, the heat generating body 54 is connected to a power supply connection portion 64 that supplies power to the wiring portion 543 and further to the heat generating portion 542.

The power supply connection portion 64 according to the second exemplary embodiment includes a housing (connector body) 641 having an attachable and detachable shape for connection and plural contact terminals 642 provided on one side surface of the housing 641 in an exposed state while being connected to the connection end portions of wires of the wiring portion 543.

For example, as illustrated in FIG. 11A, the power supply connection portion 64 is connected to a power supply source connection portion 14, which extends from a power supply (not illustrated) in the image forming apparatus 7A and is wired, and is enabled to be energized.

As illustrated in FIG. 9B and the like, the contact holder 61 is a plate-shaped member long in one direction and provided with a housing recess 61*a* for housing and holding the heat generating body 54 on one surface on the side to be brought into contact with the inner peripheral surface of the heating belt 53.

The contact holder 61 is provided with an attachment groove portion 61*b* and an attachment contact portion 61*c* that are used when being attached to the support 63, on the other surface opposite to the one surface.

In the contact holder 61, one long-side end portion on the one surface provided with the housing recess 61*a* is formed as an intake guide portion 61*d* including a bent surface that guides the heating belt 53 to be taken into the above-described contact portion FN, and the other long-side end portion on the one surface is formed as an ejection guide portion 61*e* including a curved surface that guides the heating belt 53 in a direction in which the heating belt 53 is ejected from the contact portion FN.

Each of the left and right end-portion holders 62A and 62B is a member in which a curved belt guiding and holding portion 622 that guides and holds both end portions of the heating belt 53 in the width direction so as to allow both the end portions to rotate from the inner peripheral surface thereof is provided on an inner surface of a disk-shaped body 621 in which a portion facing the pressing roll 56 is missing. The left and right end-portion holders 62A and 62B are provided with attachment recesses (not illustrated) for attaching the end portions of the support 63 on the inner side of the belt guiding and holding portion 622 of the body 621 thereof.

As illustrated in FIG. 8 and the like, the support 63 is a member longer than the length of the heat generating body 54 in the longitudinal direction. As the support 63, as illustrated in FIG. 9A, FIG. 9B, and the like, for example, a member having a shape in which long-side end portions of a flat plate long in one direction are bent substantially at a right angle in the same direction so as to have a concave shape in cross section is applied.

When the contact holder 61 is attached, as illustrated in FIG. 9B and the like, one bent end portion 63*b* of the support 63 is fitted into the attachment groove portion 61*b* of the contact holder 61, while the other bent end portion 63*c* is kept in contact with the attachment contact portion 61*c* of the contact holder 61. Thus, the support 63 supports the contact holder 61 in a state in which a portion of the contact holder 61 in the longitudinal direction is sandwiched.

As the pressing roll 56 as the pressing rotary body 52, for example, a roll is applied in which an elastic body layer, a release layer, and the like are provided on the outer peripheral surface of a columnar or cylindrical roll base body made of metal or the like.

As illustrated in FIG. 8, shaft portions 56*c* and 56*d* at both end portions in the axial direction of the pressing roll 56 are rotatably supported by a pressing mechanism (not illustrated) disposed in the housing 50. The pressing roll 56 receives a pressure such as to be pressed against the heating unit 55 from the pressing mechanism. Consequently, as illustrated in FIGS. 7 and 8, the pressing roll 56 is maintained in a state in which the roll outer peripheral surface is in pressure contact with a predetermined pressure over the longitudinal direction of the one surface 541*a* of the heat generating body 54 via the heating belt 53 in the heating unit 55.

A portion of the pressing roll 56 in pressure contact with the heating unit 55 serves as the above-described contact portion FN.

As illustrated in FIG. 8, a power passive gear 75 as an example of a driving input section is attached to one shaft portion 56*c* of the pressing roll 56, and the power passive gear 75 meshes with a power transmission gear (not illustrated) in a driving transmission device 76 disposed on the housing 70 side of the image forming apparatus 7A. Thus, when a required time for an image forming operation or the like comes, as illustrated in FIG. 7, the pressing roll 56 is driven to rotate at a predetermined speed in a direction indicated by arrow B1 by receiving a rotational force transmitted from the driving transmission device 76.

When the pressing roll 56 is driven to rotate, as illustrated in FIG. 7, the heating belt 53 in the heating unit 55 is driven to rotate in a direction indicated by arrow B2.

The heating device 5A is configured such that, when an image forming operation is executed, a region in which the heat generating body 54 of the heating unit 55 generates heat is adjusted in accordance with the difference in width size W of the recording sheet 9A passing through the contact portion FN.

For example, when a recording sheet 9A of which the width size W at the time of transport is the maximum width size W1 is to be passed, power is supplied to both the first heat generating portion 542A and the second heat generating portion 542B to cause a region corresponding to the maximum width size W1 to generate heat. When a recording sheet 9A having the minimum size W3 is to be passed, power is supplied only to the third heat generating portion 542C to cause a region corresponding to the minimum size W3 to generate heat. When a recording sheet 9A having the intermediate width size W2 is to be passed, power is supplied only to the first heat generating portion 542A to cause a region corresponding to the intermediate width size W2 to generate heat.

Thus, the heating device 5A efficiently generates heat by causing the heat generating body 54 of the heating unit 55 to conform to the difference in width size W of the recording sheet 9A.

In contrast, also in the heating device 5A, for example, when recording sheets 9A having a width size W (a size including the intermediate width size W2 and the minimum size W3) smaller than the maximum width size W1 are continuously passed and heated, a non-passage region E2 which is a region through which the recording sheets 9A do not pass is generated in the contact portion FN (actually, the heat generating body 54). Thus, since the non-passage region E2 is continuously heated from the portion where the heat generation is suppressed in the heat generating portion 542 without the heat being taken by the passing recording sheet 9A, the temperature tends to rise.

In this case, a portion of the heat generating body 54 corresponding to the non-passage region E2 becomes relatively high in temperature as compared with a passage region E1 through which the recording sheets 9A pass, so that a temperature difference occurs. Consequently, when a recording sheet 9A having a wide width is passed and heated thereafter, heating unevenness may be induced, or the contact holder 61 may be locally heated and may be adversely affected.

That is, when the thermal processing is performed in the heating device 5A as described above, as illustrated in FIGS. 8 and 10, the heat generating body 54 in the thermal processor 5*h* of the heating device 5A is in a state where an unwanted temperature difference occurs between the passage region E1 through which the recording sheet 9A passes and the non-passage region E2 of the recording sheet 9A. At this time, the portion of the heat generating body 54 corresponding to the non-passage region E2 becomes a high-temperature portion that increases in temperature during the thermal processing and causes a temperature difference, while the portion of the heat generating body 54 corresponding to the passage region E1 becomes a low-temperature portion that has a relatively lower temperature than the portion (high-temperature portion) corresponding to the non-passage region E2 during the thermal processing and causes a temperature difference.

Thus, in the heating device 5A, from the viewpoint of suppressing the occurrence of the temperature difference due to an unwanted increase in temperature in the portion (high-temperature portion) of the heat generating body 54 corresponding to the non-passage region E2, two heat pipes 1A and 1B are disposed in contact with the surface (back surface) 541*b* of the heat generating body 54 opposite to the surface 541*a* that contacts the heating belt 53 in the heating unit 55 as illustrated in FIGS. 7 to 10. Here, the high-temperature portion is a portion that generates a temperature at which the working fluid 12 enclosed in the heat pipes 1A and 1B is at least vaporizable, and is, for example, a portion having a temperature of 150° C. or higher.

Each of the heat pipes 1A and 1B employs the heat pipe 1 having the configuration according to the first exemplary embodiment.

Figure 11B:
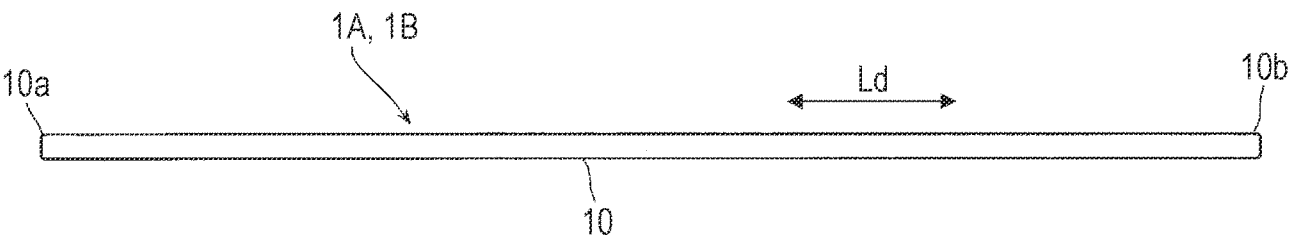
FIG. 11B is a schematic diagram illustrating a thermally conductive pipe.

As illustrated in FIGS. 11A, 11B, and the like, the heat pipes 1A and 1B have substantially the same length as the length of the heat generating portion 542 of the heat generating body 54. Since the two heat pipes 1A and 1B are disposed in parallel at positions at which an installation space is limited, heat pipes having a relatively small diameter (for example, an outer diameter in a range of 2 to 3 mm) are applied.

As illustrated in FIGS. 8, 10, and the like, the heat pipes 1A and 1B are disposed so as to be in contact with each other in the longitudinal direction (the direction extending in the passage width direction Wd of the recording sheet 9A) on the other surface 541*b* of the heat generating body 54 and to be parallel to each other at a predetermined interval in a transport direction C of the recording sheet 9A.

In the second exemplary embodiment, the configuration is disposed as follows. That is, as illustrated in FIGS. 9A, 9B, and the like, mounting grooves 65A and 65B in which the heat pipes 1A and 1B are mounted are provided in the housing recess 61*a* of the contact holder 61, and the heat pipes 1A and 1B are mounted to be housed in the mounting grooves 65A and 65B, respectively. Subsequently, when the heat generating body 54 is housed in the housing recess 61*a* of the contact holder 61, the state is maintained in which the other surface 541*b* of the heat generating body 54 is in contact with the heat pipes 1A and 1B and the heat pipes 1A and 1B are pressed into the mounting grooves 65A and 65B. The heat pipes 1A and 1B may be partially bonded and fixed to the other surface 541*b* of the heat generating body 54 with a material such as an adhesive or grease having thermal conductivity.

In the heating device 5A, as illustrated in FIG. 8 and the like, the heat pipes 1A and 1B are disposed so as to be in contact with the portion (the low-temperature portion when there is the non-passage region E2) corresponding to the passage region E1 through which a recording sheet 9A having the maximum width size W1 passes, the portion including at least the portion (the high-temperature portion) of the heat generating body 54 in the thermal processor 5*h* corresponding to the non-passage region E2. At this time, the heat pipes 1A and 1B are each configured such that the occupancy rate of the liquid transfer member 15 is maintained in the range of 20% or more and 50% or less in the region in contact with the portion corresponding to the passage region E1 through which the recording sheet 9A having the maximum width size W1 passes, the portion including the portion (high-temperature portion) corresponding to the non-passage region E2.

In the heating device 5A, as illustrated in FIGS. 8, 9A, and the like, the heat pipes 1A and 1B are disposed such that the liquid transfer member 15 is in contact with a portion of the inner wall surface 10*c* (FIGS. 1A, 1B, and the like) inside the pipe 10 that faces the heat generating body 54.

In the heating device 5A in which the heat pipes 1A and 1B are disposed, even when the portion of the heat generating body 54 at the contact portion FN corresponding to the non-passage region E2 through which the recording sheet 9A does not pass is generated and the temperature rises, the heat of the portion of the heat generating body 54 corresponding to the non-passage region E2 is moved to the portion (low-temperature portion) of the heat generating body 54 corresponding to the passage region E1 of the recording sheet 9A where the temperature becomes relatively lower than the temperature of the portion (high-temperature portion) of the heat generating body 54 corresponding to the non-passage region E2 by the action of heat transfer of the heat pipes 1A and 1B.

At this time, the heat pipes 1A and 1B generally transfer heat as follows.

For example, in each of the heat pipes 1A and 1B, heat is conducted in a portion of the pipe 10 which is in contact with the portion (high-temperature portion) of the heat generating body 54 corresponding to the non-passage region E2 of the recording sheet 9A, and the working fluid 12 inside the portion of the pipe 10 is heated and vaporized. At this time, the corresponding portions of the heat pipes 1A and 1B take the heat required for vaporization and absorb the heat. Then, the vaporized working fluid 12 moves toward a portion where the temperature and the pressure inside the pipe 10 are relatively low due to increases in temperature and pressure caused by the vaporization (for example, evaporation). The portion where the temperature and the pressure of the pipe 10 are relatively low at this time is a portion located on the central side of the pipe 10 in contact with the portion (low-temperature portion) of the heat generating body 54 corresponding to the passage region E1 of the recording sheet 9A.

In contrast, in the portion of the pipe 10 which is in contact with the portion (low-temperature portion) of the heat generating body 54 corresponding to the passage region E1 of the recording sheet 9A, the vaporized working fluid 12 is cooled, thereby being aggregated and liquefied. At this time, heat of condensation generated by the liquefaction is released and radiated at the corresponding portions of the heat pipes 1A and 1B. Then, the liquefied working fluid 12 moves, due to the capillary force of the liquid transfer member 15, substantially in the longitudinal direction Ld of the pipe 10 to the portion (high-temperature portion) in contact with the portion corresponding to the non-passage region E2 of the recording sheet 9A.

In the heat pipes 1A and 1B, by repeating the above-described operations, heat is transferred from a portion having a relatively high temperature to a portion having a relatively low temperature in the pipe 10 substantially in the longitudinal direction Ld of the pipe 10. Thus, also in the heat generating body 54 with which the heat pipes 1A and 1B are in contact, heat in a portion (high-temperature portion) corresponding to the non-passage region E2 is moved to a portion (low-temperature portion) corresponding to the passage region E1 of the recording sheet 9A.

Consequently, in the heating device 5A, as compared with a case where the heat pipes 1A and 1B are not disposed, an increase in temperature in the non-passage region E2 is suppressed, and occurrence of an unwanted temperature difference in the heat generating body 54 is also suppressed.

In the heating device 5A, even when the cross-sectional area S1 of the pipe 10 in the transverse direction Sd is reduced, excellent thermal conductivity performance may be obtained as compared with a case where a heat pipe in which the occupancy rate of the liquid transfer member 15 is not in the range of 20% or more and 50% or less is used.

At this time, since the occupancy rate of the liquid transfer member 15 in each the heat pipes 1A and 1B is maintained in the range of 20% or more and 50% or less, for example, a sufficient passage space for the movement of the vaporized working fluid 12 is secured inside the pipe 10 as described above, so that the movement to the low-temperature portion of the pipe 10 is smoothly performed. Furthermore, as described above, the capillary force of the liquid transfer member 15 having an occupancy rate of 20% or more of the liquefied working fluid 12 is obtained, so that the movement (transfer) to the high-temperature portion of the pipe 10 is smoothly performed. That is, for example, in the heat pipes 1A and 1B, the circulating movement of the working fluid 12 inside the pipe 10 is efficiently performed, and the heat transfer is also efficiently performed.

Thus, in the heating device 5A, a temperature difference generated in the passage width direction Wd of the heat generating body 54 in the thermal processor 5*h*, that is, an unwanted temperature difference generated between the high-temperature portion corresponding to the non-passage region E2 and the low-temperature portion corresponding to the passage region E1 in the heat generating body 54 is efficiently suppressed. In particular, in the heating device 5A, in order to heat and melt an image formed of a toner and satisfactorily fix the image to a recording sheet 9A, for example, heating is performed in a range of 150° C. to 230° C. by the heat generating body 54; however, an unwanted temperature difference generated in the heat generating component 54 is effectively suppressed although the heat pipes 1A and 1B having the relatively small diameters described above are applied.

Thus, in the heating device 5A, even in a case where recording sheets 9A having a width size W (a size including the intermediate width size W2 and the minimum width size W3) smaller than the maximum width size W1 are continuously passed, and then a recording sheet 9A having a width size W (W1 or W2) relatively larger than the small width size W (W2 or W3) is passed to perform the heating processing, heating with less variation in heating temperature caused by the unwanted temperature difference may be performed.

In the image forming apparatus 7A, even when the recording sheets 9A having the relatively small width size W (W2, W3) are continuously used and the recording sheet 9A having the width size W (W1, W2) relatively larger than the width size W (W2, W3) is used to perform image formation, the toner image formed by the imaging device 2A is satisfactorily fixed by heating in the heating device 5A with less variation in heating temperature caused by the unwanted temperature difference. Thus, in the image forming apparatus 7A, it is possible to obtain a uniform image with less fixing unevenness (heating unevenness) caused by the unwanted temperature difference.

Modification of Second Exemplary Embodiment

Figure 12A:
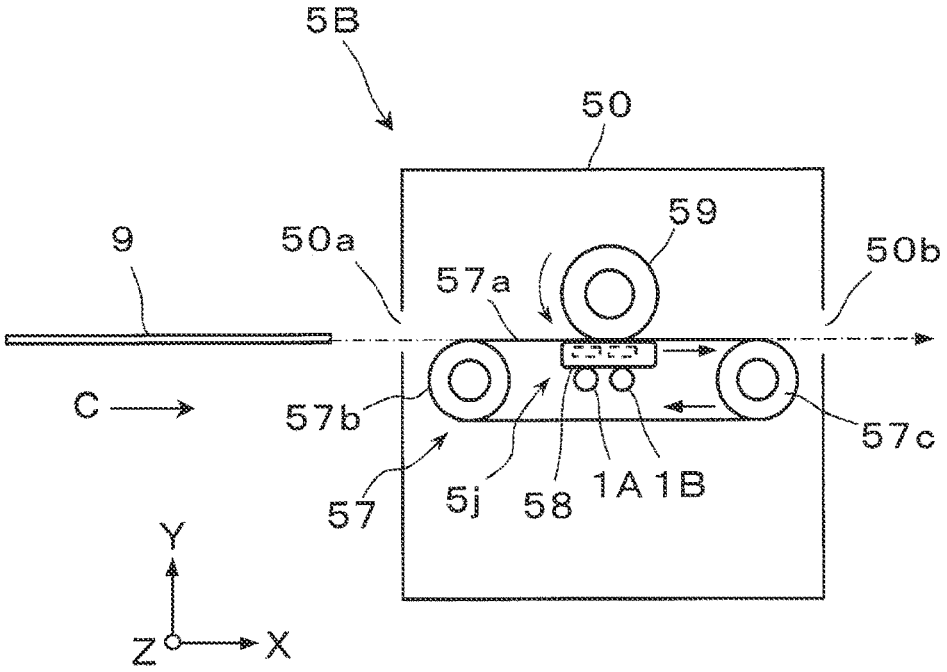
FIG. 12A is a schematic diagram illustrating the inside of a cooling device according to a modification of the second exemplary embodiment.
Figure 12B:
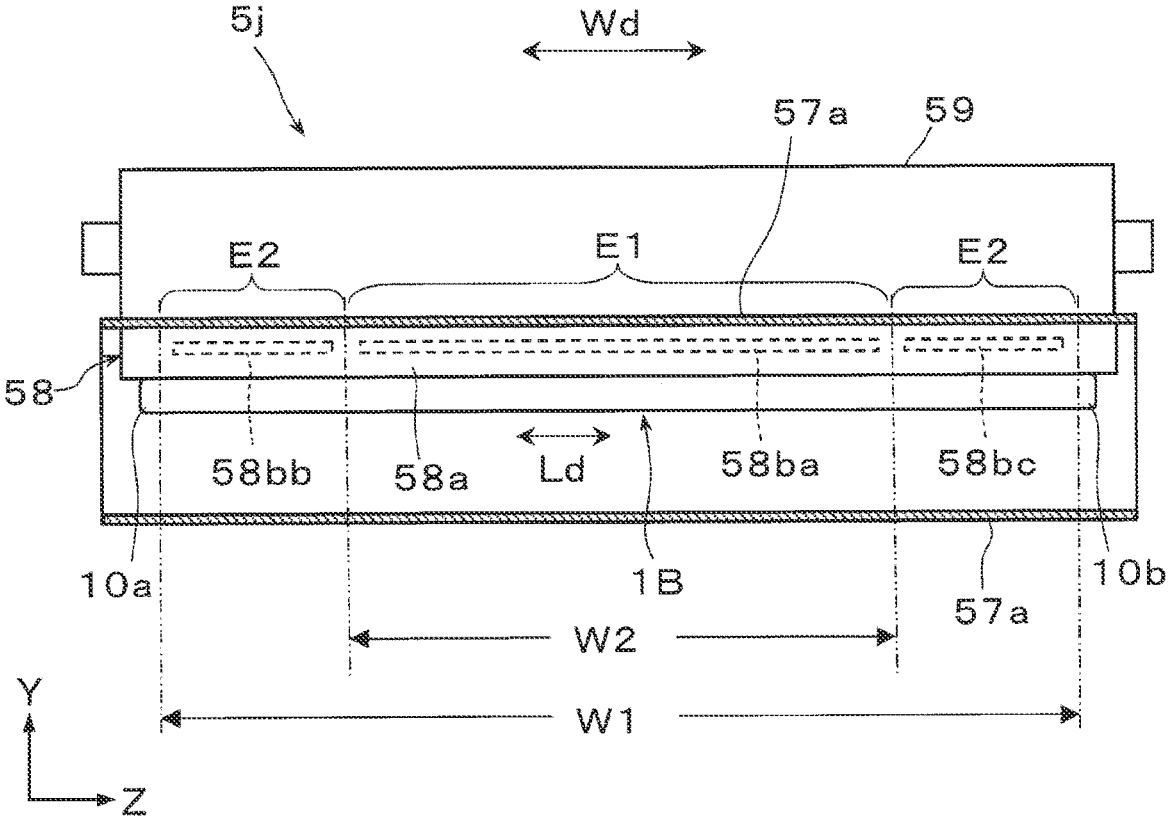
FIG. 12B is a schematic partly sectioned view illustrating a portion of the cooling device of FIG. 12A.

Although the heating device 5A is exemplified as the thermal processing device 5 in the second exemplary embodiment, the thermal processing device 5 may be, for example, a cooling device 5B including a thermal processor 5*j* that performs thermal processing of cooling a processing target object 9 passing in contact as illustrated in FIGS. 12A and 12B.

The cooling device 5B is configured by disposing, in an internal space of a housing 50 having an inlet 50*a* and an outlet 50*b* for a processing target object 9, devices such as a transport device 57 for the processing target object 9, a cooler 58 as an example of the thermal processor 5*j* that cools the processing target object 9 transported by the transport device 57, and a pressing rotary body 59 that presses the processing target object 9 against the cooler 58.

As the processing target object 9 among these, for example, a sheet-shaped or plate-shaped object to be cooled is applied. In the cooling device 5B, as the processing target object 9, for example, those having a feed width W of the maximum width size W1 and those having a feed width W of an intermediate width size W2 narrower than the maximum width size W1 are targeted.

As the transport device 57, for example, a device using a belt transport method is used. Specifically, the transport device 57 includes an endless transport belt 57*a* having thermal conductivity, support rolls 57*b* and 57*c* around which the transport belt 57*a* is wound and supported so as to be rotatable in a direction indicated by arrows, a driving device (not illustrated) that transmits rotational power to one of the support rolls 57*b* and 57*c*, and the like.

The pressing rotary body 59 having, for example, a roll shape is used. The pressing rotary body 59 is disposed so as to be driven to rotate by pressing the transport belt 57*a* of the transport device 57 against the cooler 58.

The cooler 58 is disposed in contact with the inner surface of the transport belt 57*a* of the transport device 57 and constituted as a processor that performs cooling. Specifically, the cooler 58 includes a support 58*a* having thermal conductivity and a cooling body 58*b* that continuously feeds or circulates a cooling medium (gas or liquid) (not illustrated) to the support 58*a* through a pipe, a path, or the like in the passage width direction Wd of the processing target object 9. A portion of the cooler 58 that contacts the inner surface of the transport belt 57*a* functions as a major cooler.

The support 58*a* is a long member having a size longer than the maximum width size W1 of the processing target object 9 in the passage width direction Wd. The cooling body 58*b* is a cooler linearly provided to extend in the longitudinal direction of the support 58*a* (the direction extending in the passage width direction Wd of the recording sheet 9A) and in a parallel state separated from each other in the passage width direction Wd of the processing target object 9. The cooling body 58*b* is coupled to a device (not illustrated) that generates and feeds a cooling medium.

In the cooling device 5B, the processing target object 9 is cooled when the processing target object 9 transported by the transport belt 57*a* of the transport device 57 passes through the cooler 58. At this time, the processing target object 9 passes while being pressed against the cooler 58 by the pressing rotary body 59.

Also in the cooling device 5B, for example, when processing target objects 9 having a width size W (intermediate width size W2) smaller than the maximum width size W1 are continuously passed and cooled, a non-passage region E2 that is a region through which the processing target objects 9 do not pass is generated in the cooler 58. Thus, a portion of the cooler 58 corresponding to the passage region E1 through which the processing target objects 9 pass absorbs heat by cooling during the thermal processing and the temperature thereof rises, whereas a portion of the cooler 58 corresponding to the non-passage region E2 of the processing target objects 9 does not absorb heat by cooling during the thermal processing and thus tends to be in a low temperature state.

In this case, while the portion of the cooler 58 corresponding to the passage region E1 is relatively high in temperature, the portion of the cooler 58 corresponding to the non-passage region E2 is locally low in temperature, a temperature difference occurs in the entire cooler 58, and consequently, cooling unevenness may be induced when a processing target object 9 having a large width size W (W1) is passed and cooled thereafter.

That is, in the cooling device 5B, when the thermal processing of cooling is performed as described above, the cooler 58 which is the thermal processor 5*j* is in a state in which an unwanted temperature difference occurs between the portion corresponding to the passage region E1 of the processing target object 9 and the portion corresponding to the non-passage region E2 of the processing target object 9, as illustrated in FIG. 12B. At this time, the portion of the cooler 58 corresponding to the passage region E1 of the processing target object 9 becomes a high-temperature portion that increases in temperature and causes a temperature difference, while the portion of the cooler 58 corresponding to the non-passage region E2 becomes a low-temperature portion that has a relatively lower temperature than the portion (high-temperature portion) corresponding to the passage region E1 and causes a temperature difference.

In the cooling device 5B, as illustrated in FIGS. 12A and 12B, two heat pipes 1A and 1B are disposed in contact with a surface (back surface) of the cooler 58 opposite to a surface thereof that contacts the transport belt 57*a*, from the viewpoint of suppressing occurrence of an unwanted temperature difference between the portion (high-temperature portion) of the cooler 58 corresponding to the passage region E1 of the processing target object 9 and the portion (low-temperature portion) of the cooler 58 corresponding to the non-passage region E2 of the processing target object 9. Here, the high-temperature portion is a portion that generates a temperature at which the working fluid 12 enclosed in the heat pipes 1A and 1B is at least vaporizable, and is, for example, a portion having a temperature of 100° C. or higher.

Each of the heat pipes 1A and 1B employs the heat pipe 1 having the configuration according to the first exemplary embodiment.

In the cooling device 5B, as illustrated in FIG. 12B, the heat pipes 1A and 1B are disposed in a state in contact with the portion of the cooler 58 in the thermal processor 5*j* corresponding to the passage region E1 through which the processing target object 9 having at least the maximum width size W1 passes. At this time, the heat pipes 1A and 1B are configured such that the occupancy rate of the liquid transfer member 15 is maintained in a range of 20% or more and 50% or less in a region that contacts the portion corresponding to the passage region E1 through which the processing target object 9 having the maximum width size W1 passes.

In the cooling device 5B, the heat pipes 1A and 1B are each disposed such that the liquid transfer member 15 is in contact with a portion of the inner wall surface 10*c* (FIGS. 1A, 1B, and the like) inside the corresponding pipe 10 which faces the cooler 58.

In the cooling device 5B in which the heat pipes 1A and 1B are disposed, even when the portion of the cooler 58 that the processing target object 9 contacts (via the transport belt 57*a*) corresponding to the non-passage region E2 of the processing target object 9 is generated and a temperature difference occurs, the heat of the portion of the cooler 58 corresponding to the passage region E1 is moved to the portion (low-temperature portion) corresponding to the non-passage region E2 of the processing target object 9 where the temperature is relatively lower than the temperature of the portion (high-temperature portion) corresponding to the passage region E1 by the action of heat transfer of the heat pipes 1A and 1B.

Consequently, in the cooling device 5B, as compared with a case where the heat pipes 1A and 1B are not disposed, when the portion corresponding to the non-passage region E2 of the processing target object 9 is generated, a temperature rise in the passage region E1 is suppressed, and occurrence of an unwanted temperature difference in the cooler 58 is suppressed.

In the cooling device 5B, even when the cross-sectional area S1 of the pipe 10 in the transverse direction Sd is reduced, excellent thermal conductivity performance is obtained as compared with the case where the heat pipe in which the occupancy rate of the liquid transfer member 15 is not in the range of 20% or more and 50% or less is used.

Another example of the thermal processing device 5 may be, for example, a drying device including a thermal processor 5*h* that performs thermal processing of drying a processing target object 9 and a thermally conductive pipe 1 such as a heat pipe disposed at a portion of the thermal processor 5*h* where a temperature difference occurring in the passage width direction Wd of the processing target object 9 is to be suppressed. The thermal processing of drying at this time is thermal processing of heating.

The thermally conductive pipe 1 represented by the heat pipe disposed in the thermal processing device 5 may be a thermally conductive pipe 1 (FIGS. 4A, 4B, 5A, and 5B) having the configuration described in the modification of the first exemplary embodiment. The number of the thermally conductive pipes 1 arranged in the thermal processing device 5 is not limited to two, and may be one, or three or more. The transport device 57 disposed in the thermal processing device 5 may be a transport device using a transport method other than the belt transport method.

Although the second exemplary embodiment exemplifies the image forming apparatus 7A including the imaging device 2A and the heating device 5A as the processing system 7, the processing system 7 may have another configuration.

Figure 13A:
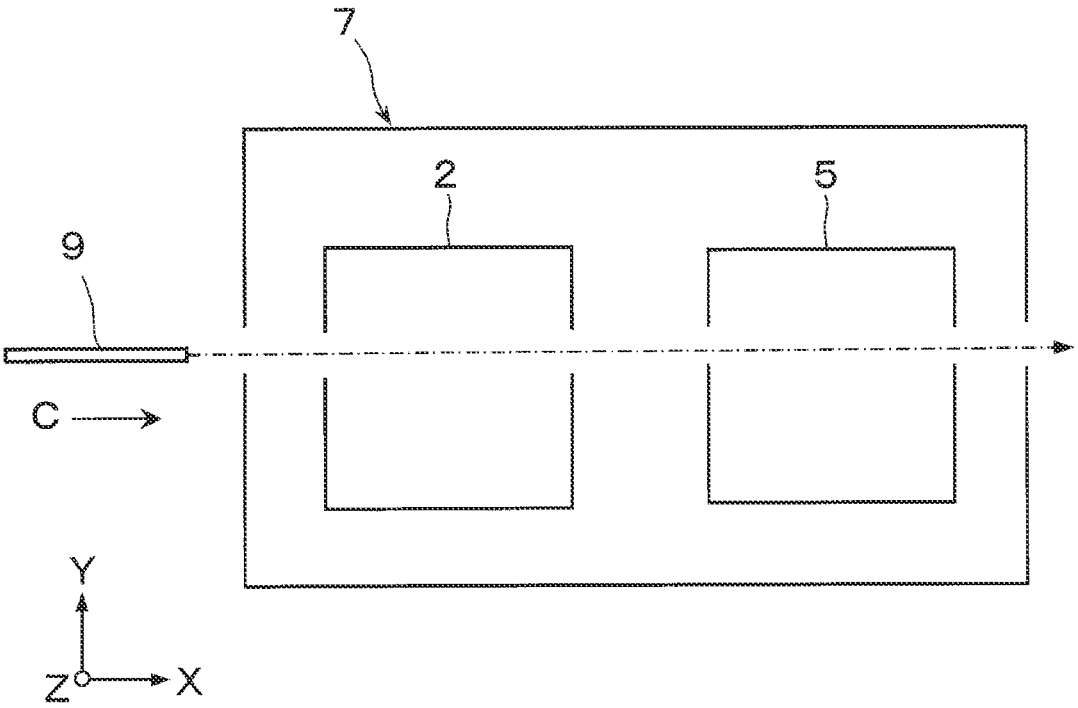
FIG. 13A is a conceptual diagram illustrating a processing system according to a modification of the second exemplary embodiment.

Another example of the processing system 7 may be, for example, a processing system including a coating apparatus, a printer, another image forming apparatus, or the like, in which a processing apparatus 2 that performs another processing such as coating, printing, or image formation by another image forming method on a processing target object 9 is employed as another processing apparatus 2 that performs another processing other than the thermal processing, as illustrated in FIG. 13A. In this case, as the thermal processing device 5, a suitable device such as the heating device 5A, the cooling device 5B, or the drying device described above is used.

Figure 13B:
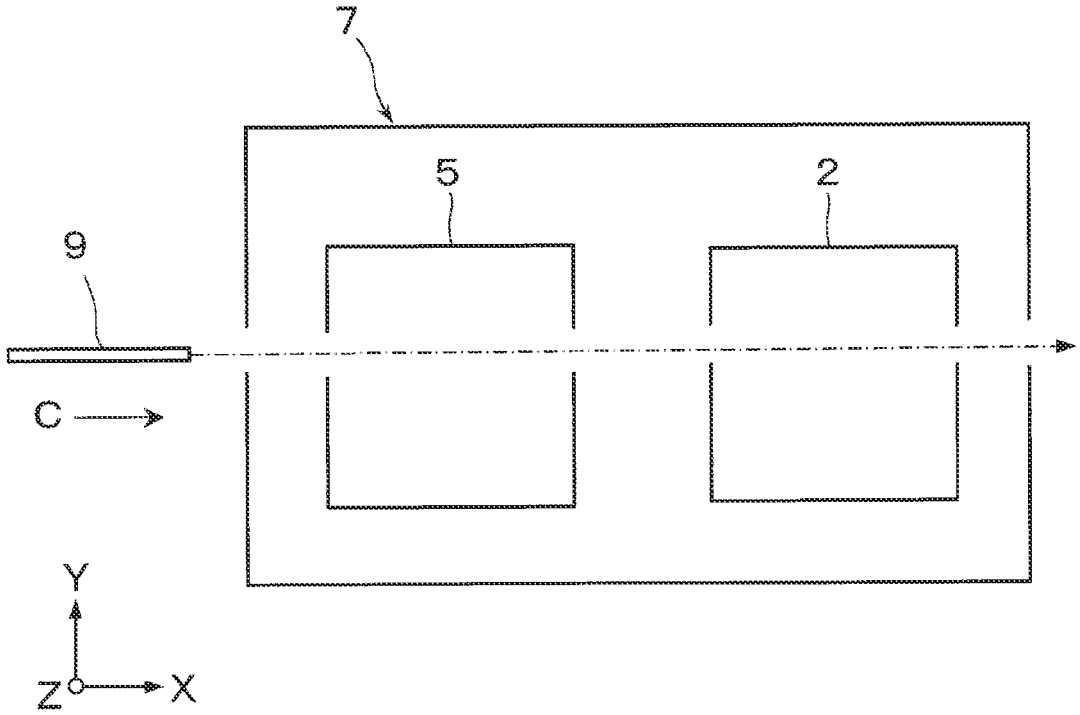
FIG. 13B is a conceptual diagram illustrating another configuration example of the processing system according to the modification of the second exemplary embodiment.

As illustrated in FIG. 13B, the processing system 7 is also applicable to an apparatus in which the processing apparatus 2 performs another processing other than the thermal processing on a processing target object 9 after passing through the thermal processing device 5.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A thermally conductive pipe, comprising:

a pipe having closed both end portions;

a working fluid that is enclosed in inside of the pipe and that is vaporized and liquefied; and a liquid transfer member that extends in a longitudinal direction of the inside of the pipe and that transfers the liquefied working fluid at least in the longitudinal direction, wherein an occupancy rate of a cross-sectional area of the liquid transfer member to a cross-sectional area in a transverse direction of the inside of the pipe is in a range of 20% or more and 50% or less.

2. The thermally conductive pipe according to claim 1, wherein the occupancy rate is maintained in a longitudinal direction of the pipe.

3. The thermally conductive pipe according to claim 2, wherein the liquid transfer member is in contact with at least a portion of an inner wall surface of the pipe.

4. The thermally conductive pipe according to claim 3, wherein the liquid transfer member is in contact with a portion extending in a longitudinal direction of the inner wall surface of the pipe.

5. The thermally conductive pipe according to claim 4, wherein the liquid transfer member is constituted by a plurality of wires each having an outer diameter of 0.06 mm or less.

6. The thermally conductive pipe according to claim 3, wherein the liquid transfer member is in contact with an entire region of the inner wall surface of the pipe.

7. The thermally conductive pipe according to claim 3, wherein the liquid transfer member is constituted by a plurality of wires each having an outer diameter of 0.06 mm or less.

8. The thermally conductive pipe according to claim 2, wherein the liquid transfer member is constituted by a plurality of wires each having an outer diameter of 0.06 mm or less.

9. The thermally conductive pipe according to claim 1, wherein the liquid transfer member is in contact with at least a portion of an inner wall surface of the pipe.

10. The thermally conductive pipe according to claim 9, wherein the liquid transfer member is in contact with a portion extending in a longitudinal direction of the inner wall surface of the pipe.

11. The thermally conductive pipe according to claim 10, wherein the liquid transfer member is constituted by a plurality of wires each having an outer diameter of 0.06 mm or less.

12. The thermally conductive pipe according to claim 9, wherein the liquid transfer member is in contact with an entire region of the inner wall surface of the pipe.

13. The thermally conductive pipe according to claim 12, wherein the liquid transfer member is constituted by a plurality of wires each having an outer diameter of 0.06 mm or less.

14. The thermally conductive pipe according to claim 9, wherein the liquid transfer member is constituted by a plurality of wires each having an outer diameter of 0.06 mm or less.

15. The thermally conductive pipe according to claim 1, wherein the liquid transfer member is constituted by a plurality of wires each having an outer diameter of 0.06 mm or less.

16. The thermally conductive pipe according to claim 1, wherein the pipe is a pipe having a circular cross section having an outer diameter of 3 mm or less.

17. The thermally conductive pipe according to claim 16, wherein the pipe and the liquid transfer member are made of oxygen-free copper, and a surface of the pipe is subjected to an antioxidant treatment.

18. A thermal processing device, comprising:

a thermal processor that performs thermal processing of heating or cooling a processing target object passing in contact with the thermal processor;

a thermally conductive pipe installed at a portion of the thermal processor where a temperature difference in a passage width direction of the processing target object is to be suppressed; and wherein the thermally conductive pipe according to claim 1 is used as the thermally conductive pipe.

19. The thermal processing device according to claim 18, wherein the occupancy rate of the thermally conductive pipe is maintained at least in a range between a portion of the pipe that contacts a high-temperature portion of the thermal processor that causes a temperature difference due to a temperature rise during the thermal processing of the thermal processor and a portion of the pipe that contacts a low-temperature portion of the thermal processor that causes a temperature difference due to a temperature fall during the thermal processing of the thermal processor.

20. A processing system, comprising:

a thermal processing device including a thermal processor that performs thermal processing of heating or cooling a processing target object passing in contact with the thermal processor; and another processing device that performs another processing other than the thermal processing on the processing target object before or after passing through the thermal processing device, wherein the thermal processing device includes the thermal processing device according to claim 18.

* * * * *